US010989489B2

(12) United States Patent
Downey et al.

(10) Patent No.: US 10,989,489 B2
(45) Date of Patent: Apr. 27, 2021

(54) BOLT RELEASE MECHANISM FOR FIREARM

(71) Applicant: Sturm, Ruger & Comany, Inc., Southport, CT (US)

(72) Inventors: Matthias Downey, Warner, NH (US); Jonathan Philip Mather, Grafton, NH (US); Adam Jay Taylor, Unity, NH (US)

(73) Assignee: Sturm, Ruger & Company, Inc.

( * ) Notice: Subject to any disclaimer, the term of this patent is extended or adjusted under 35 U.S.C. 154(b) by 0 days.

(21) Appl. No.: 16/376,352

(22) Filed: Apr. 5, 2019

(65) Prior Publication Data

US 2020/0318924 A1 Oct. 8, 2020

(51) Int. Cl.

| | |
|---|---|
| ***F41A 17/42*** | (2006.01) |
| ***F41A 19/11*** | (2006.01) |
| ***F41A 19/49*** | (2006.01) |
| ***F41A 17/52*** | (2006.01) |

(52) U.S. Cl.

CPC ..... *F41A 17/42* (2013.01); *F41A 17/52* (2013.01); *F41A 19/11* (2013.01); *F41A 19/49* (2013.01)

(58) Field of Classification Search

CPC ..... F41A 17/42; F41A 19/11; F41A 17/52; F41A 17/40; F41A 17/30; F41A 17/32; F41A 19/49

See application file for complete search history.

(56) References Cited

U.S. PATENT DOCUMENTS

| | | | | |
|---|---|---|---|---|
| 2,539,554 A * | 1/1951 | Sampson | ..... | F41A 19/31 42/69.02 |
| 2,872,849 A | 2/1959 | Simpson | | |
| 3,290,993 A * | 12/1966 | Irusta | ..... | F41A 19/33 89/140 |

(Continued)

FOREIGN PATENT DOCUMENTS

| | | | |
|---|---|---|---|
| DE | 355093 | * | 6/1922 |
| GB | 619413 | | 3/1949 |
| WO | WO 2005/047804 A2 | | 5/2005 |

OTHER PUBLICATIONS

KIDD Innovative Design, KIDD Search (Kidd Auto Body Release, Part No. 55), Feb. 18, 2018, pp. 1-3.

(Continued)

*Primary Examiner* — Stephen Johnson

(74) *Attorney, Agent, or Firm* — The Belles Group, P.C.

(57) ABSTRACT

A firearm with manually operated bolt release includes a receiver defining a longitudinally-extending cavity, a barrel, and a bolt slideably mounted in the receiver for reciprocating axial movement between a forward closed breech position in battery with the barrel and a rearward open breech position. A recoil spring biases the bolt forward towards the closed breech position. A manually actuated bolt release is pivotably mounted in the firearm and movable between an engaged position and a disengaged position. The bolt release includes a locking portion configured to selectively engage a locking recess formed on the bolt for holding the bolt in the open breech position, and disengage the locking recess for releasing the bolt to reclose the breech. In one embodiment, the bolt may be automatically disengaged from the bolt release by retracting the bolt a second time.

30 Claims, 25 Drawing Sheets

(56) References Cited

U.S. PATENT DOCUMENTS

| | | | | |
|---|---|---|---|---|
| 3,735,519 | A | 5/1973 | Fox | |
| 4,019,423 | A | 4/1977 | Johnson et al. | |
| 4,128,042 | A | 12/1978 | Atchisson | |
| 4,455,919 | A * | 6/1984 | Osborne | F41A 17/38 89/138 |
| 4,567,810 | A * | 2/1986 | Preston | F41A 17/38 89/142 |
| 4,920,855 | A | 5/1990 | Waters | |
| 6,874,492 | B1 * | 4/2005 | Schavone | F41B 11/51 124/31 |
| 7,395,747 | B2 | 7/2008 | Murello | |
| 8,381,628 | B1 | 2/2013 | Wheatley | |
| 8,745,909 | B1 | 6/2014 | Sylvester | |
| 8,985,005 | B1 | 3/2015 | Dubois et al. | |
| 9,115,941 | B2 | 8/2015 | Tertin et al. | |
| 10,151,549 | B1 | 12/2018 | Batchelor | |
| 2014/0053716 | A1 | 2/2014 | Norton | |
| 2016/0187090 | A1 | 6/2016 | Mather et al. | |
| 2017/0160026 | A1 | 6/2017 | Walther et al. | |
| 2018/0087860 | A1 | 3/2018 | Sullivan et al. | |

OTHER PUBLICATIONS

ARK2114, Ruger 10/22 Auto Bolt Release Install, Published Jun. 7, 2017, pp. 1-3.

Autodesk, Inc., Ruger 10/22 DIY Auto Bolt Release, Tableft Workshop—Posted Nov. 15, 2010, http://www.autodesk.com, pp. 1-15.

"Gunsmither 10/22 Bolt Bar and Extractor Tool—Product Review," Online Retrieved from the Internet on Sep. 17, 2020 at URL http://guntoters.com/blog/2017/01/04/gunsmither-1022-bolt-bar-and-extractor-tool-product-review, entire document, p. 4, Fig. 1, dated Jan. 4, 2017.

International Search Report and Written Opinion issued in International Application No. PCT/US20/26365 dated Oct. 13, 2020.

* cited by examiner

BOLT RELEASE MECHANISM FOR FIREARM

BACKGROUND

The present invention generally relates to firearms, and more particularly to a bolt release mechanism for firearms such as rifles.

In magazine-fed semi-automatic rifles, it is often desirable to manually open the breech by retracting the bolt rearward, and then lock the bolt in the rearward position for various reasons. For example, one such reason is to allow visual inspection of the chamber to ensure that a round of ammunition does not remain when placing the firearm in a safe condition in preparation for maintenance or repair of the firearm. Another reason is to allow a round to be manually chambered if the magazine is empty. The bolt release of the firearm acts as a lock which selectably holds the bolt rearward until manually released by the user through some additional action.

Some aftermarket or modified bolt release mechanisms may be susceptible to unintentionally releasing the bolt forward if the firearm is accidentally bumped or jarred. Such designs do to positively lock the bolt reward. On the other hand, some bolt releases may require the user to move the bolt release twice—once when locking the bolt rearward initially, and another to then release the bolt to reclose the breech.

Improvements in bolt releases are desired.

SUMMARY OF THE INVENTION

Embodiments of the present invention provide an improved bolt release mechanism for a firearm which locks the bolt rearward in an open breech position via a positive engagement that is resistant to inadvertently bumping or jarring of the firearm. The bolt release further advantageously only requires the user to actuate the bolt release once for locking the breech in the open position. To reclose the breech, the user simply pulls the bolt back rearward a short distance to automatically disengage the bolt release, and releases the bolt to automatically return the bolt forward to the closed breech position, thereby eliminating the need to manually move the bolt release a second time.

In one aspect, a firearm with bolt release mechanism includes: a longitudinal axis; a receiver defining a longitudinally-extending cavity; a barrel supported by the receiver; a bolt slideably mounted in the receiver for reciprocating axial movement between a forward closed breech position in battery with the barrel and a rearward open breech position; a recoil spring biasing the bolt forward towards the closed breech position; a manually actuated bolt release pivotably movable between an engaged position and a disengaged position; the bolt release including a locking portion configured to selectively (1) engage a locking recess formed on the bolt for holding the bolt in the open breech position when the bolt release is in the engaged position, and (2) to disengage the locking recess for releasing the bolt from the open breech position when the bolt release is in the disengaged position.

In another aspect, a firearm with bolt release mechanism includes: a longitudinal axis; a receiver defining a longitudinally-extending cavity; a barrel supported by the receiver; a bolt slideably mounted in the receiver for reciprocating axial movement between a forward closed breech position in battery with the barrel and a rearward open breech position; a recoil spring biasing the bolt towards the closed breech position; a trigger housing detachable mounted to the receiver and comprising a trigger-actuated firing mechanism; a manually actuated bolt release pivotably mounted in the trigger housing; the bolt release having a flat plate-like body including a locking portion configured to (1) selectively engage a locking recess formed on the bolt for holding the bolt in the open breech position when the bolt release is in an upper engaged position, and (2) to disengage the locking recess for releasing the bolt from the open breech position when the bolt release is in a disengaged position.

In another aspect, a method for operating a bolt release of a firearm includes: providing a firearm including an axially reciprocating bolt movable between a rearward open breech position and a forward closed breech position, a recoil spring biasing the bolt towards the closed breech position, a pivotably movable bolt release arranged to selectively engage the bolt, and an operating spring biasing the bolt release towards a lower position disengaged from the bolt; manually retracting the bolt a first time to the open breech position; manually moving the bolt release from the lower position to an upper position; and engaging a locking portion of the bolt release with a locking recess formed in the bolt, wherein the bolt is restrained in the open breech position by the bolt release.

BRIEF DESCRIPTION OF THE DRAWINGS

The features of the exemplary embodiments will be described with reference to the following drawings where like elements are labeled similarly, and in which.

Figure 1:
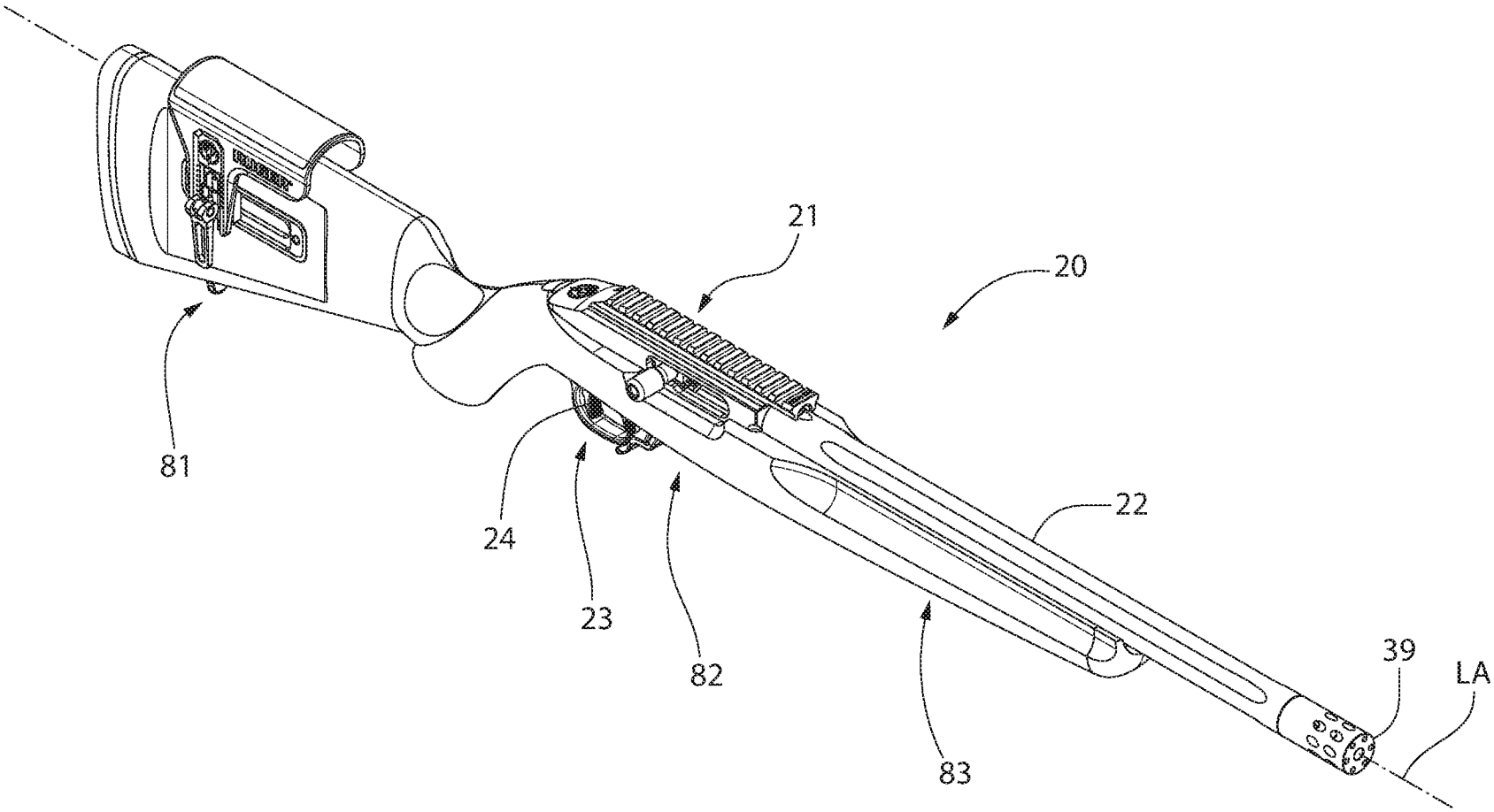
FIG. 1 is a top perspective view of a firearm with bolt release mechanism according to the present disclosure.
Figure 2:
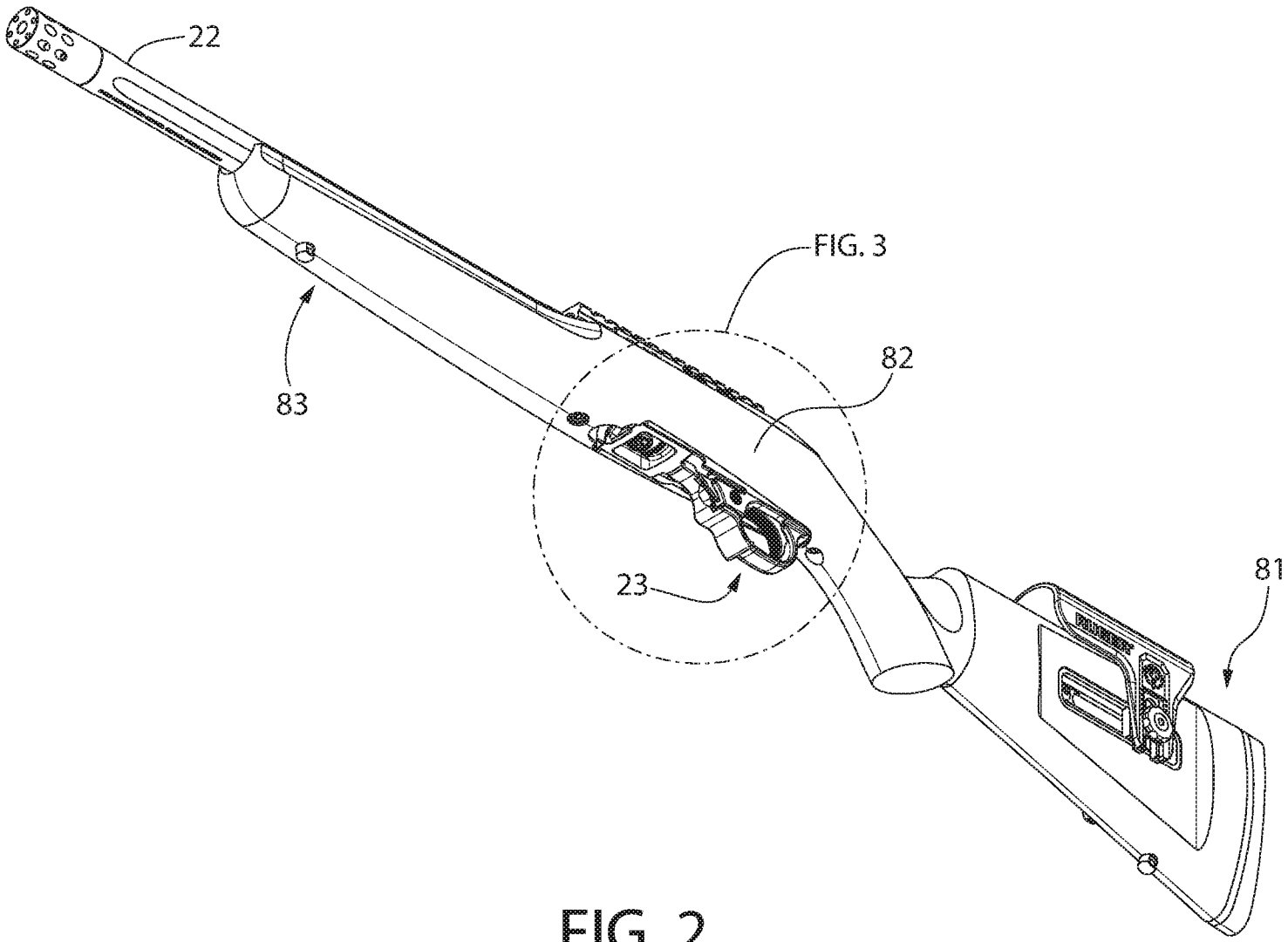
FIG. 2 is a bottom perspective view thereof.

All drawings are schematic and not necessarily to scale. Parts shown and/or given a reference numerical designation in one figure may be considered to be the same parts where they appear in other figures without a numerical designation for brevity unless specifically labeled with a different part number and described herein.

DETAILED DESCRIPTION OF EMBODIMENTS

The features and benefits of the invention are illustrated and described herein by reference to preferred but non-limiting exemplary ("example") embodiments. This description of the embodiments is intended to be read in connection with the accompanying drawings, which are to be considered part of the entire written description. Accordingly, the invention expressly should not be limited to such embodiments illustrating some possible non-limiting combination of features that may exist alone or in other combinations of features; the scope of the invention being defined by the claims appended hereto.

In the description of embodiments disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "affixed," "connected," "coupled," "interconnected," and similar refer to a relationship wherein structures may be secured or attached to one another either directly or indirectly through intervening structures, as well as both movable or rigid attachments or relationships, unless expressly described otherwise.

FIGS. 1-13 depict a magazine-fed semi-automatic firearm 20 including a bolt release 100 according to the present disclosure. In one non-limiting embodiment, the firearm as illustrated may be a rifle. However, the firearm could be another type of long gun such as a shortened rifle known as a carbine with shorter barrel, for example, which includes the present bolt release. Accordingly, the bolt release is not limited in its applicability to any particular firearm format alone in which it is desirable to manually lock the breech in an open position.

Firearm 20 includes a longitudinal axis LA, receiver 21, barrel 22 coupled thereto, bolt 50, and a trigger-actuated firing mechanism 23 which may be supported by the receiver or a detachable trigger housing 23-1 as illustrated. Firing mechanism 23 includes movable trigger 24 for actuating the mechanism. The firearm includes a chassis or stock 80 including buttstock 81, mid-stock 82 to which the receiver 21 is mounted by a pair of takedown screws 21-1, and a forearm 83 extending for a portion of the length of the barrel 22. Stock 80 may be formed of wood and/or glass-filled polymer in some embodiments.

A downwardly open magazine well 32 is formed by the receiver 21 which holds an ammunition magazine 33 comprising a plurality of cartridges detachably mounted in the well. Such magazines may a straight or curved box-style which contains a spring-biased stack of ammunition cartridges which are uploaded into the breech area 34 by a spring mechanism for chambering into the rearwardly open chamber 36 of barrel 22 by the bolt 50 in a conventional manner when cycling the action (example of box magazine illustrated schematically by dashed lines in FIG. 6). In other embodiments, as best shown in FIGS. 3-5, 7, and 10, as the magazine 33 may be a rotary magazine such as the Ruger® 10-round rotary magazine mounted in magazine well 32 flush with the bottom of the mid-stock 82. In one embodiment, the cartridges may rimfire cartridges with crushable rims to detonate the charge, such as .22LR. However, the cartridges may be centerfire cartridges in other embodiments of the firearm with a centrally located percussion cap in the rear exposed end of the base of the cartridge. Both types of cartridge are well known to those skilled in the art without further undue elaboration.

Figure 3:
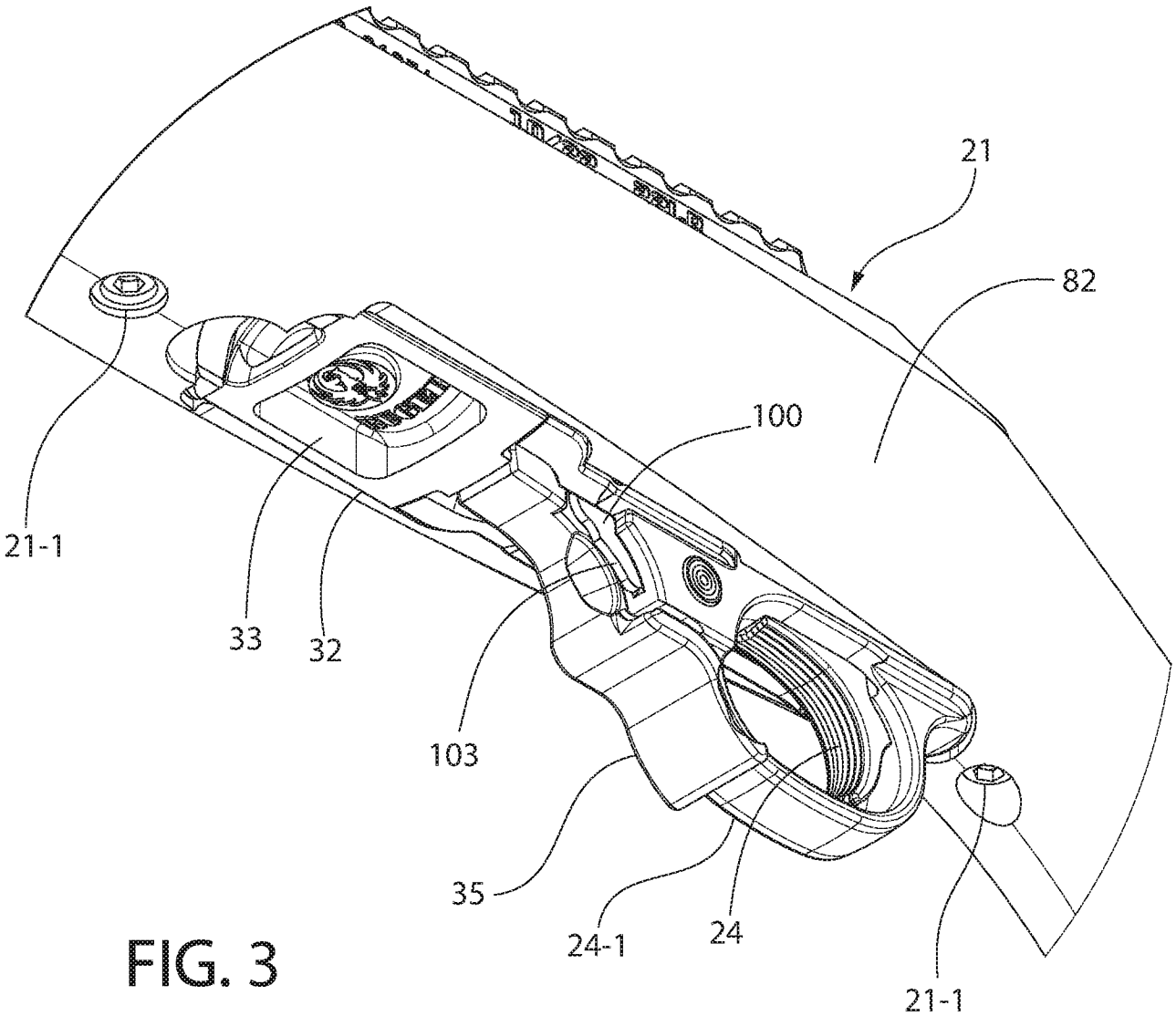
FIG. 3 is an enlarged view taken from FIG. 2 of the mid-stock area.
Figure 4:
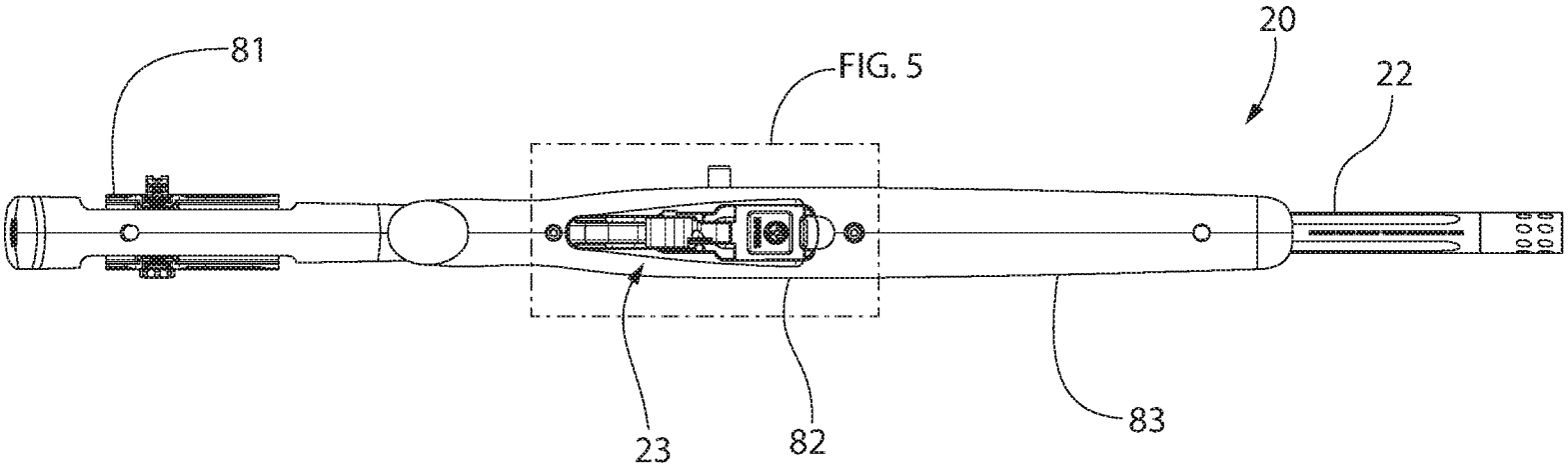
FIG. 4 is a bottom plan view of the firearm of FIG. 1.
Figure 7:
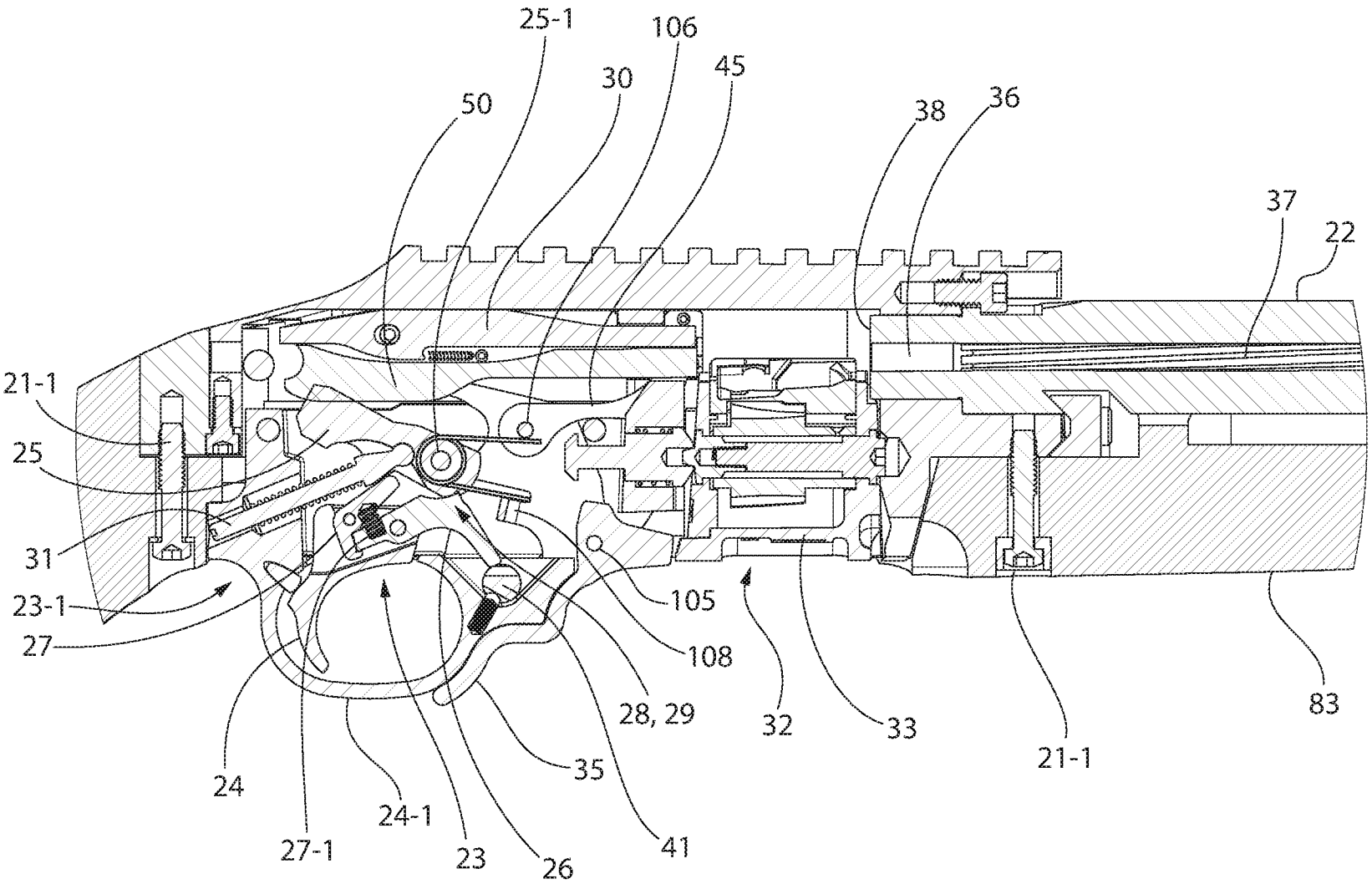
FIG. 7 is an enlarged view taken from FIG. 6 of the action of the firearm.
Figure 8:
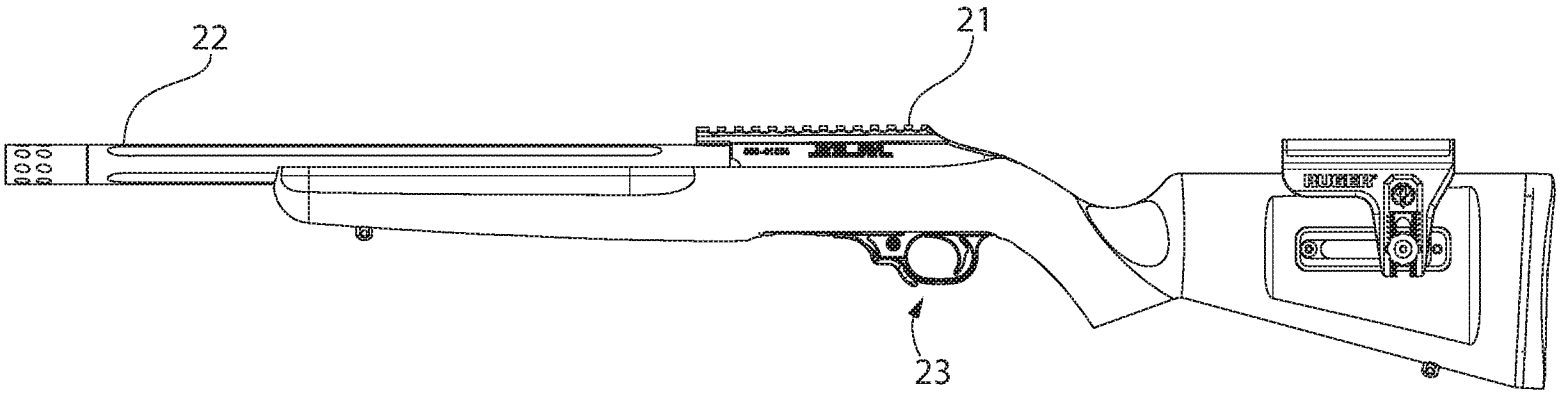
FIG. 8 is a left side view of the firearm of FIG. 1.
Figure 9:
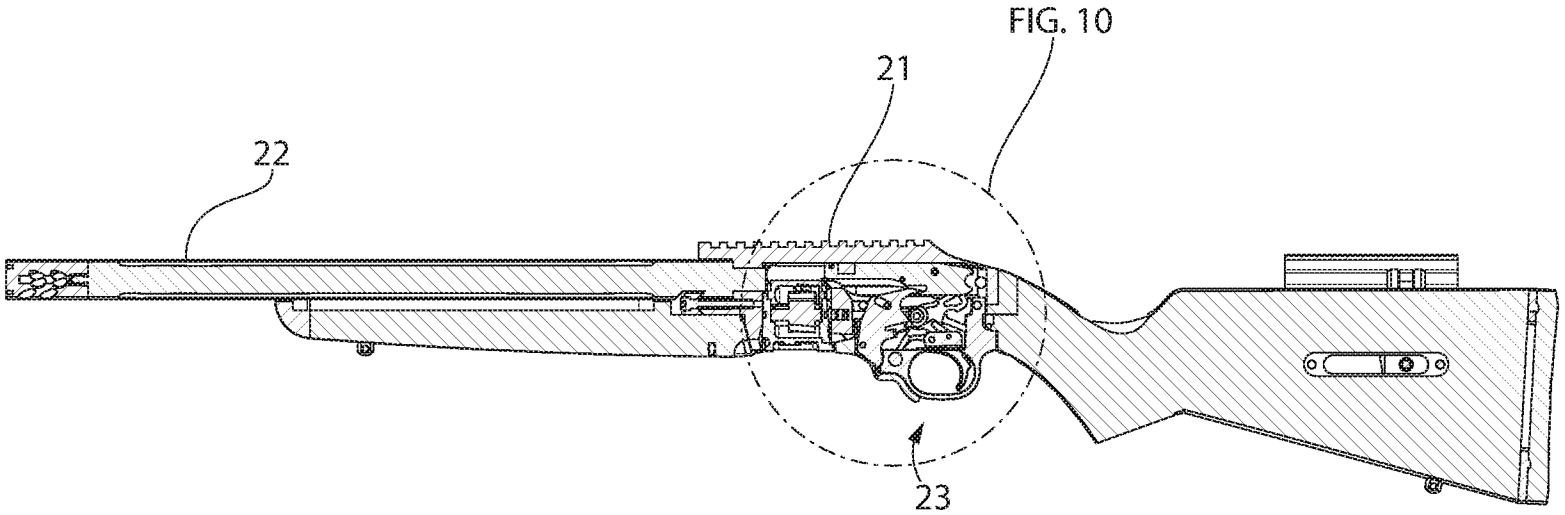
FIG. 9 is a left side cross sectional view thereof.
Figure 10:
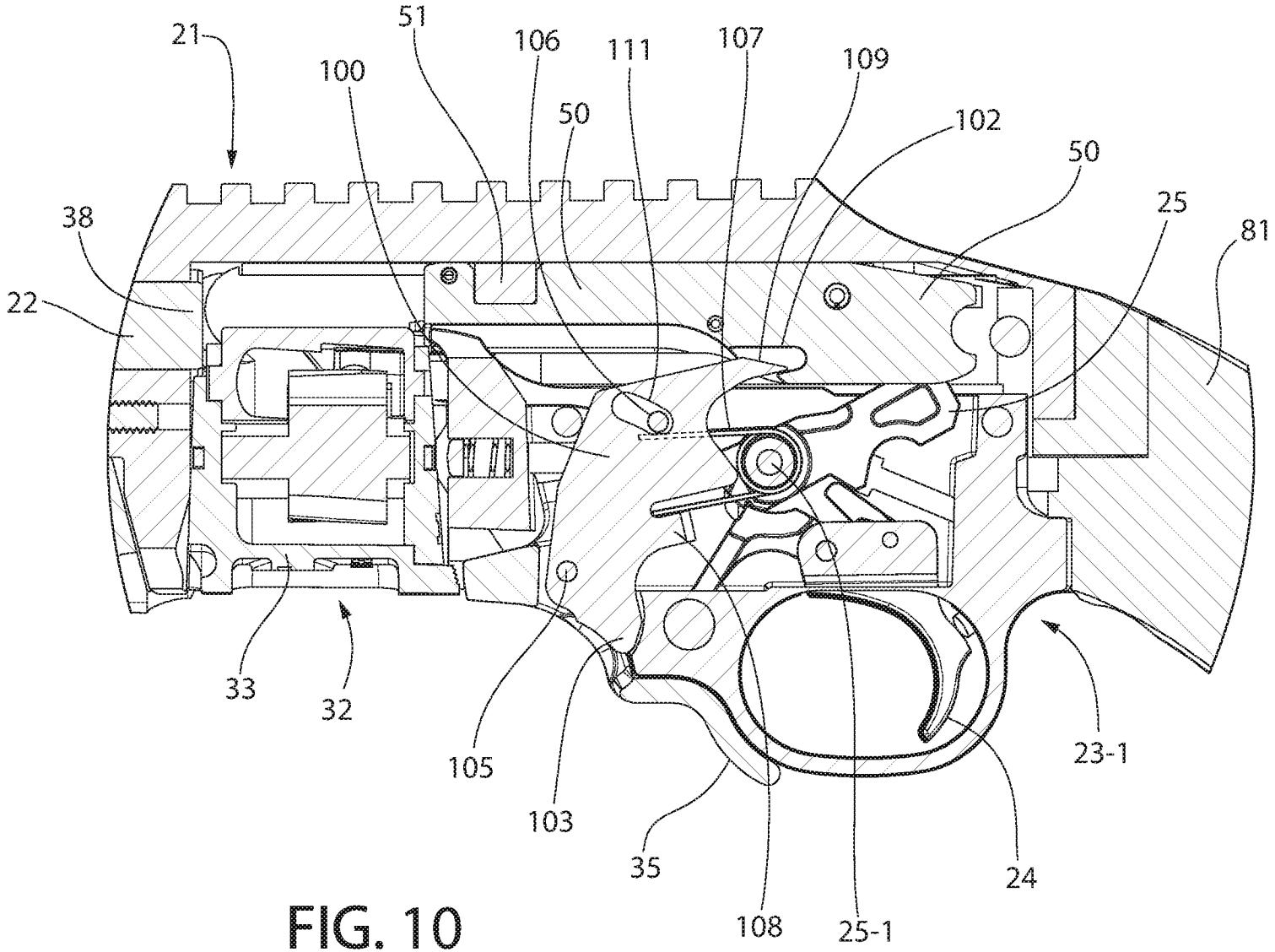
FIG. 10 is an enlarged view taken from FIG. 9 showing the bolt release mechanism in a first operational position.

The magazine 33 is removably retained in the magazine well 32 by a pivotable magazine release such as elongated lever latch 35. Latch 35 may be pivotably mounted by transverse pivot pin 105 to the receiver 21, or alternatively as shown in the figures by detachable trigger housing 23-1 which houses the firing mechanism. Latch 35 is mounted proximate to the rear of the magazine well 32 and has a front end configured to engage and retain magazine 33 in the firearm. Latch 35 may have an elongated body which has a compound curved shape complementary configured to the shape of the trigger guard 24-1 as best shown in FIGS. 3, 7, and 10. When in the rearward latched position shown in these figures for retaining the magazine 33 in magazine well 32, the latch fits the contours of and nests abuttingly against the trigger guard. This form-fitting configuration of the magazine release latch helps prevent accidentally bumping and activating the magazine release latch. To release the magazine 33 from the firearm 20, the user pivots the latch downwards and forward about pivot pin 105 to a forward position.

Barrel 22 includes an axial bore 37 extending longitudinally and axially from a rear breech end 38 to a front muzzle end 39 from which a bullet or slug is discharged from the firearm. The centerline of bore 37 is coaxial with and defines the longitudinal axis LA of the firearm. The rear breech end 38 of the barrel 22 defines a rearwardly open diametrically enlarged chamber 36 configured for holding a cartridge. Chamber 36 communicates with bore 37 which forms the projectile passageway for the bullet or slug.

Receiver 21 defines an axially elongated internal cavity 40 which slidably carries and supports the bolt assembly 50. Cavity 40 extends along the longitudinal axis LA between the open front end 18 in communication with the barrel chamber 36 for loading cartridges therein and a closed rear end 19 defined by vertical rear end wall 43. Barrel 22 is coupled to the front end 18 of the receiver. In one non-limiting embodiment, the receiver 21 includes an axially elongated right ejection port 44 through which spent cartridge casings are ejected form the firearm after firing by ejector 45 (see, e.g. FIGS. 7 and 13).

Figure 13:
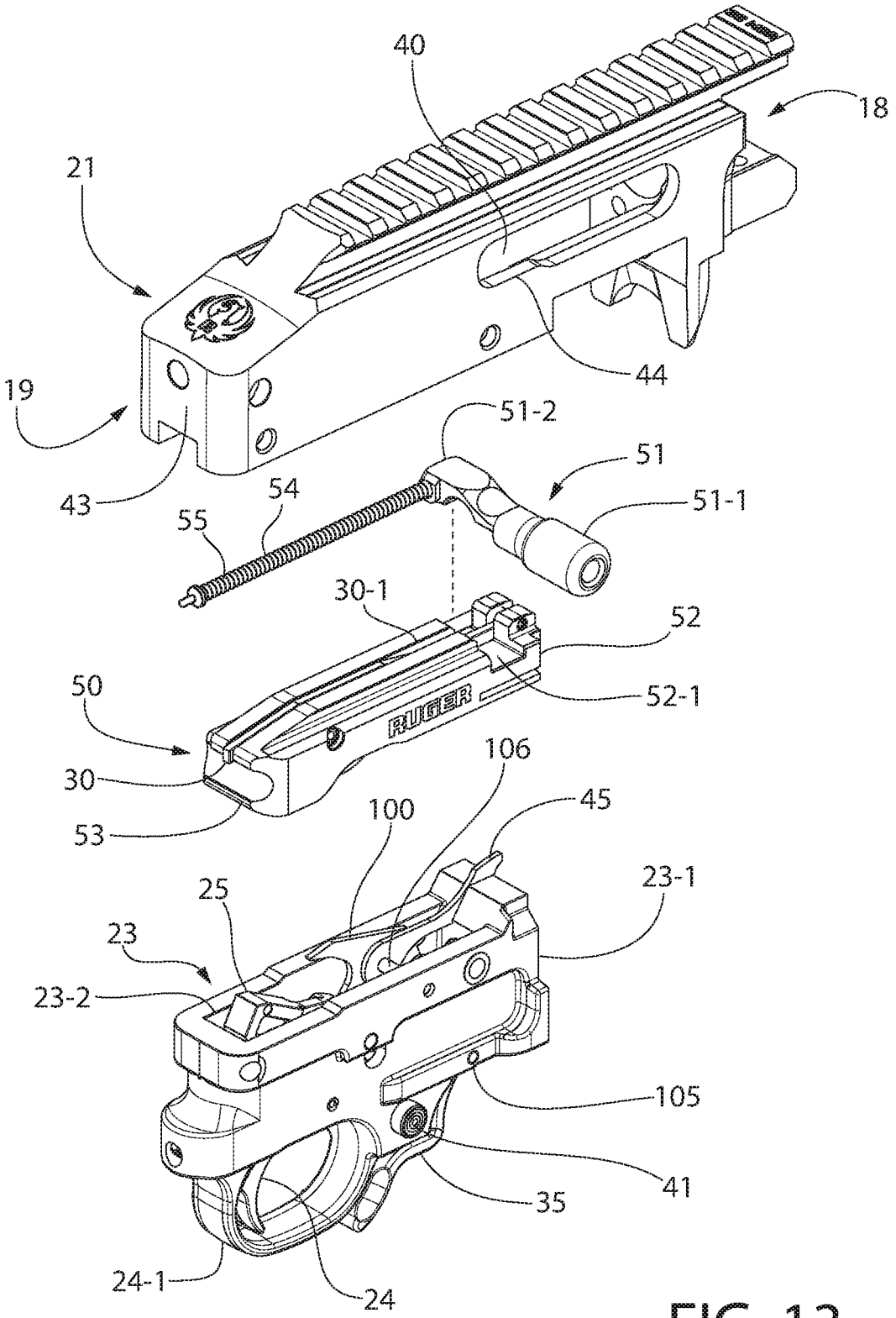
FIG. 13 is an exploded perspective view of the receiver, bolt assembly, and trigger housing of the firearm.
Figure 14:
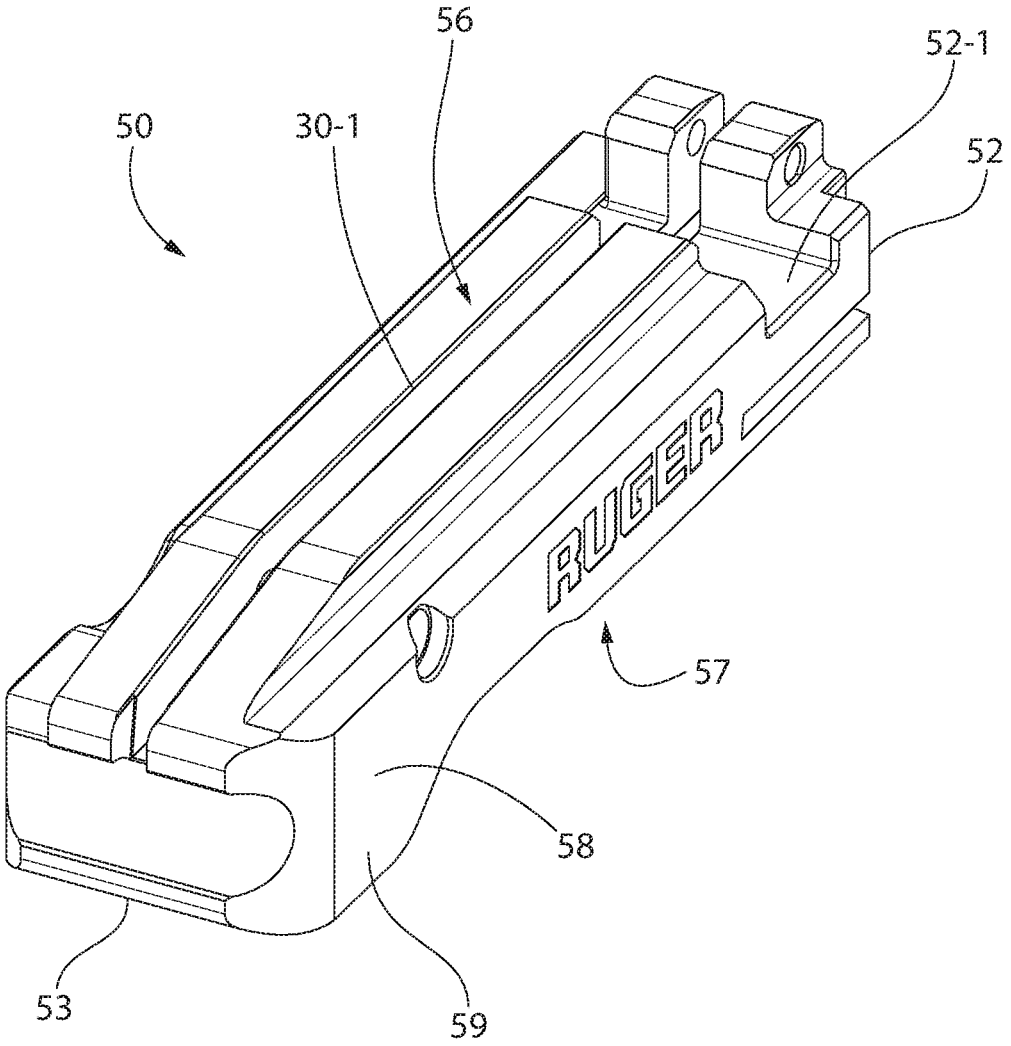
FIG. 14 is a top perspective view of the bolt body.
Figure 15:
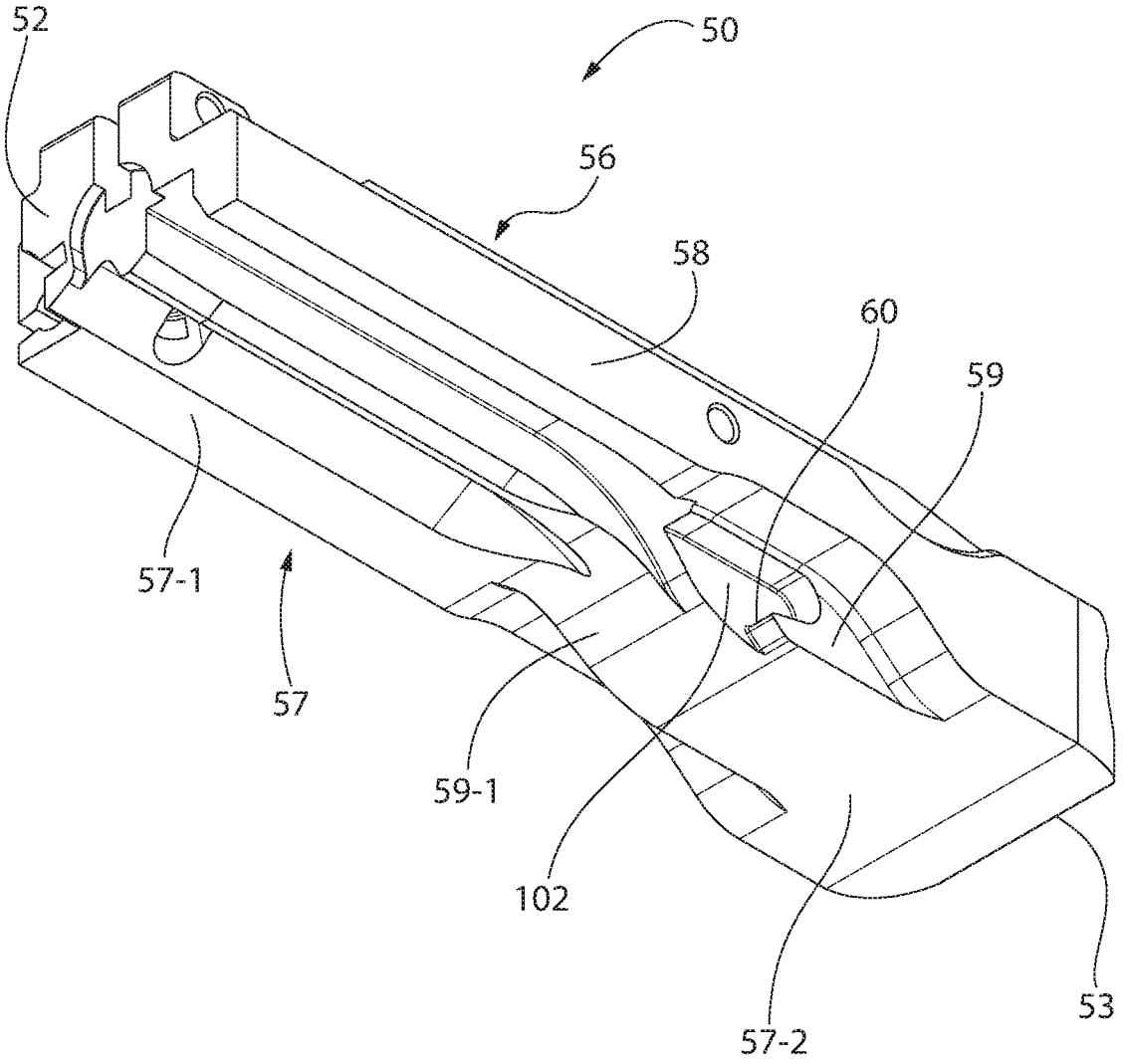
FIG. 15 is a bottom perspective view thereof.

For convenience of assembly and maintenance/repair, the firing mechanism 23 may be housed in trigger housing 23-1 best shown in FIGS. 7, 10, and 13. Trigger housing 23-1 is detachably and removably mounted to the lower portion of the receiver 21. The trigger housing 23-1 includes a plurality of transversely oriented pivot pins which movably mount the various firing component in an open internal cavity 23-2 of the housing. A push-able cylindrical manual safety 41 is transversely movably mounted in trigger housing 23-1 and configured to interact with the sear for rendering the firing mechanism in either a safe or fire condition. The trigger housing includes a open loop-shaped bottom trigger guard 24-1 which surrounds and helps protect the trigger 24 against unintentional actuation. Trigger housing 23-1 may be formed of any suitable metallic and/or polymeric material. In one non-limiting example, the trigger housing may be formed of heat-stabilized, glass-filled, polymer which may be injection molded.

The firing mechanism 23 may include the following components mounted in the trigger housing 23-1: a pivotable and cockable hammer 25; pivotable sear 26 which is configured and operable to hold the hammer in a rear cocked position (see, e.g. FIG. 3); a pivotable sear disconnector 27 operably engaged with the sear; and disconnector spring 27-1 acting between the disconnector and sear. Hammer 25 is biased forward by hammer strut-spring assembly 31. Pulling the trigger 24 rearward operates to lift disconnector 27 which in turn rotates the sear 26. This disengages a hook or ledge 28 formed on the front of the sear from a downward facing sear notch 29 on the hammer 25, thereby releasing spring-biased hammer 25 forward which strikes the rear end of firing pin 30 slidably carried by the bolt 50. This drives the firing pin forward to strike a chambered cartridge held in the chamber 36 of the barrel 22 for discharging the firearm 20.

FIGS. 14-21 show the bolt 50 body in isolation. Referring generally to FIGS. 7, 10, and 13-21, bolt 50 has an axially elongated block-like body of generally rectilinear (e.g. rectangular cuboid) shape having a monolithic unitary structure. The bolt body includes a front end 52, rear end 53, top 56, bottom 57, and a pair of opposing lateral sides 58 defined by walls of the body which generally meet along longitudinally-extending and laterally-extending corner edges. Front end 52 defines the vertical breech face that engages the breech end 38 of the barrel 22 adjacent the cartridge chamber 36 when the breech is closed. Bolt 50 is received and axially movable in the internal cavity 40 of the receiver 21 along longitudinal axis LA between forward closed breech and rearward open breech positions. In the closed breech position, the bolt 50 (i.e. breech face) is in battery with the rear breech end 38 of barrel 22 to close the chamber 36 for firing. In the open breech position, the bolt is axially displaced rearward to allow a spent cartridge casing to be ejected and for loading a fresh cartridge into the breech area of the receiver for chambering by the bolt when returned forward to the closed breech position.

Firing pin 30 is mounted in an upwardly open and longitudinally-extending firing pin slot 30-1 formed in the bolt body. The rear end of firing pin 30 remains exposed at the rear end 53 of the bolt (see, e.g. FIG. 13) for striking by the hammer 25 to discharge the firearm via a trigger pull. It bears noting that the firing pin 30 shown is for a rimfire firearm since the forward striking end of the firing pin is transversely offset from longitudinal axis LA and barrel bore 37. This positioning allows the firing pin to strike the peripheral rim area of the cartridge rear in a known manner for rimfire-fired firearms. In other embodiments, a centerfire cartridge may be used for a centerfire firearm in which the firing pin is coaxially aligned with the barrel bore.

A bolt handle-recoil spring assembly is coupled to the bolt 50 to manually cycle the bolt between its forward and rearward positions by hand. Bolt 50 is also automatically moved under recoil forces between the forward and rearward positions when the action is cycled after discharging the firearm to eject a spent cartridge casing and chamber a new fresh cartridge. Cavity 40 of receiver 21 therefore has an axial length sufficient to provide the full range of motion necessary for the bolt assembly 50 moving rearward under recoil to open the breech for extracting and ejecting a spent cartridge casing, and uploading a new cartridge into the barrel chamber 36 from the magazine 33.

The bolt handle-recoil spring assembly includes cocking handle 51, recoil spring 54, and spring guide rod 55 which supports and guides the spring. The spring may be a helical compression spring in one embodiment as shown. Handle 51 has a transversely elongated body which is received and nests at least partially in an upwardly open transverse socket 52-1 formed proximate to the front end of the bolt 50. The operating end 51-1 of the handle 51 may include a cylindrical knob for grasping or have another shape such as a curved finger-pull bar configured for engaging a finger. The opposite spring seating end 51-2 of handle 51 is coupled to spring guide rod 55 and seats one end of spring 54. When the bolt handle-recoil spring assembly is coupled to bolt 50, the guide rod 55 and spring 54 extend rearward from the cocking handle 51 along the lateral side of the bolt.

The manually actuated bolt release 100 and related method for operating the same will now be further described. The bolt release mechanism of the present invention generally includes bolt release 100 which cooperates and interfaces with the bolt 50. FIGS. 14-21 show details of bolt 50 in isolation. FIGS. 22-27 show details of bolt release 100 in isolation.

Referring now generally to FIGS. 3-5, 7, and 10-27, bolt release 100 has a generally flattened plate-like main body 100-1 which lies in a vertical plane. The main body defines a rear locking portion 101 configured to selectively engage a locking recess 102 of the bolt 50, and a front and lower operating portion 103 used to actuate and move the bolt release to the upper engaged position. Bolt release may preferably be formed of a suitable metallic plate such as steel, aluminum, titanium, or other. The bolt release is elongated in width and height which generally extends from the trigger guard area to the bottom of the bolt 50. Bolt release 100 is mounted to trigger housing 23-1 by a round pivot hole 104 in the body which receives transverse pivot pin 105. Pivot pin 105 defines an axis of rotation RA1 of the bolt release. It bears noting that this same pivot pin 105 is shared with the bolt release lever latch 35 for efficiency of parts and assembly. In other possible embodiments, the bolt release 100 may have a separate transverse pivot pin.

To limit the rotational or pivotal movement of the bolt release 100, an arcuately curved guide slot 111 receives a guide pin 106 to limit the rotational movement of the bolt release. Slot 111 has a width in the short dimension transverse to its length which is substantially commensurate with the diameter of guide pin 106 (albeit just slightly wider than the diameter of the pin to allow receipt of the pin in the slot). In one embodiment, as illustrated, the guide pin 106 may further serve as the same pivot pin for mounting the ejector 45 to the trigger housing 23-1 for efficiency of parts and assembly. Thought of another way, the pivot pin for ejector 45 may also serve as the guide pin for the bolt release 50. In other embodiments, a separate guide pin may be provided for the bolt release.

Bolt release 50 is pivotably moveable between an upper engaged position lockingly engaged with the bolt to arrest its forward (but not rearward) movement, and a lower disengaged position releasing the bolt for forward movement. The bolt release is biased downwards towards the disengaged position by an operating spring 107. In one embodiment, operating spring 107 may be a torsion spring having the coiled portion mounted about the hammer pivot pin 25-1 (see, e.g. FIG. 7). One leg 107-2 acts and is braced against the stationary guide pin 106, and the other leg 107-1 acts on a lateral extension arm 108 projecting perpendicularly outwards from the main body of the bolt release (see, e.g. FIGS. 7 and 22). The extension arm 108 is transversely oriented to the main body 100-1 of the bolt release and lies in a vertical plane perpendicular to the vertical plane of the main body. Extension arm 108 may be formed as an integral unitary structural part of the monolithic bolt release body as shown. A different spring mounting arrangement and/or different types of springs may be used in other possible embodiments.

In one embodiment, the rear locking portion 101 of bolt release 100 comprises a finger-shaped locking protrusion 109 projecting rearwardly from the main body of the release. Locking protrusion 109 lies in the same vertical plane as the main body 100-1 of the bolt release, and may be considered to form a contiguous extension thereof with a narrower top to bottom height. The free terminal end 110 of locking protrusion 109 defines a hook configured for at least partial insertion into the locking recess 102 of the bolt 50 when the bolt release is in the engaged position. The locking protrusion 109 thus is operable to form an interlocked relationship with the bolt 50 when mutually engaged to arrest the forward movement of the bolt for maintaining an open breech. The free terminal end 110 of the locking protrusion 109 may culminate in a point, which may be slightly radiused or rounded as shown (see, e.g. FIGS. 22-25). This gives the locking protrusion a gradually diminishing height moving from the main body 100-1 of the bolt release rearward towards the pointed terminal end 110.

The unique geometry on both the bolt release locking recess 102 and hooked retention ledge 60 of bolt 50 and bolt release locking protrusion 109 also advantageously mitigate a "perching" condition where the bolt release might inadvertently stops the forward travel of the bolt. The angled cut surfaces 109-2, 60-2 on the bolt release and bolt retention ledge respectively interact and cause the bolt release to be forced downward away from the bolt locking recess 102 when the bolt 50 returns forward to the closed breech position. The bolt release 100 prevents the forward travel of the bolt only if the user physically pushes the bolt release into a high enough to the engaged position to fall into alignment with the bolt locking recess 102 on the underside of the bolt.

Figure 16:
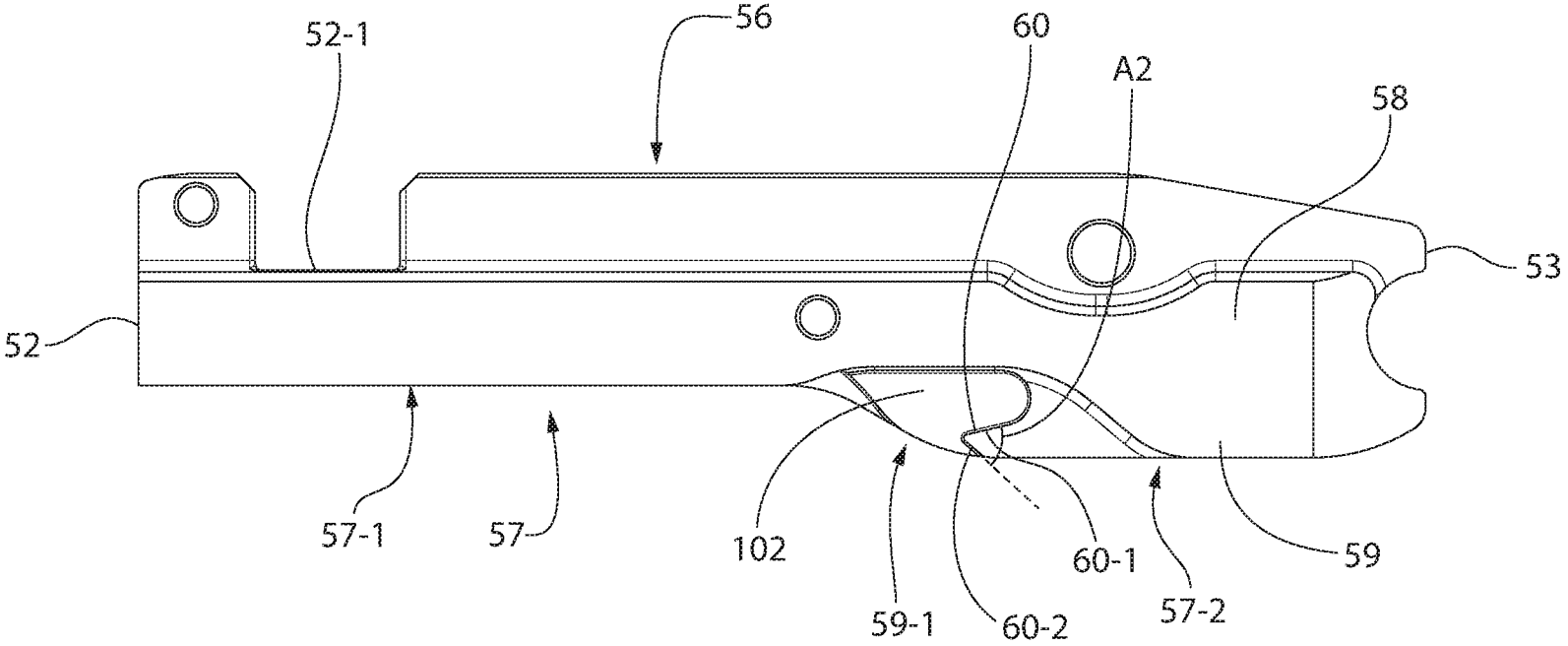
FIG. 16 is a left side view thereof.
Figure 17:
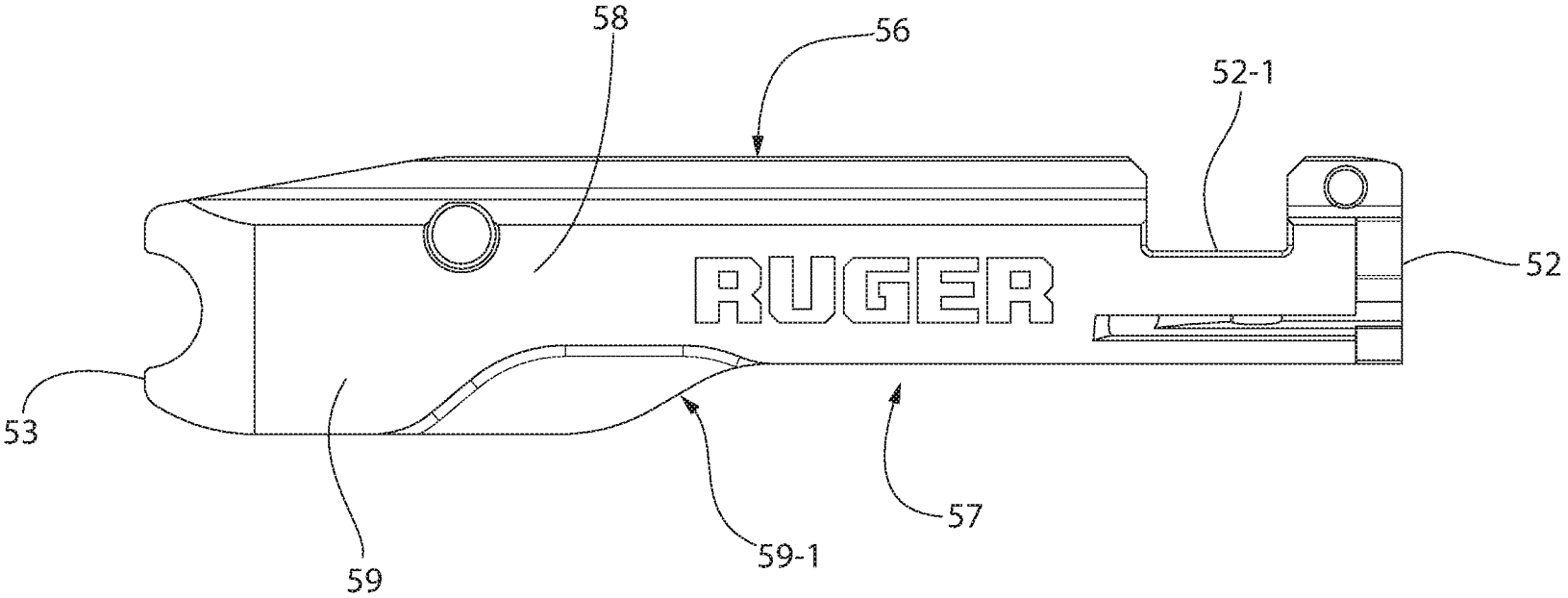
FIG. 17 is a right side view thereof.
Figure 18:
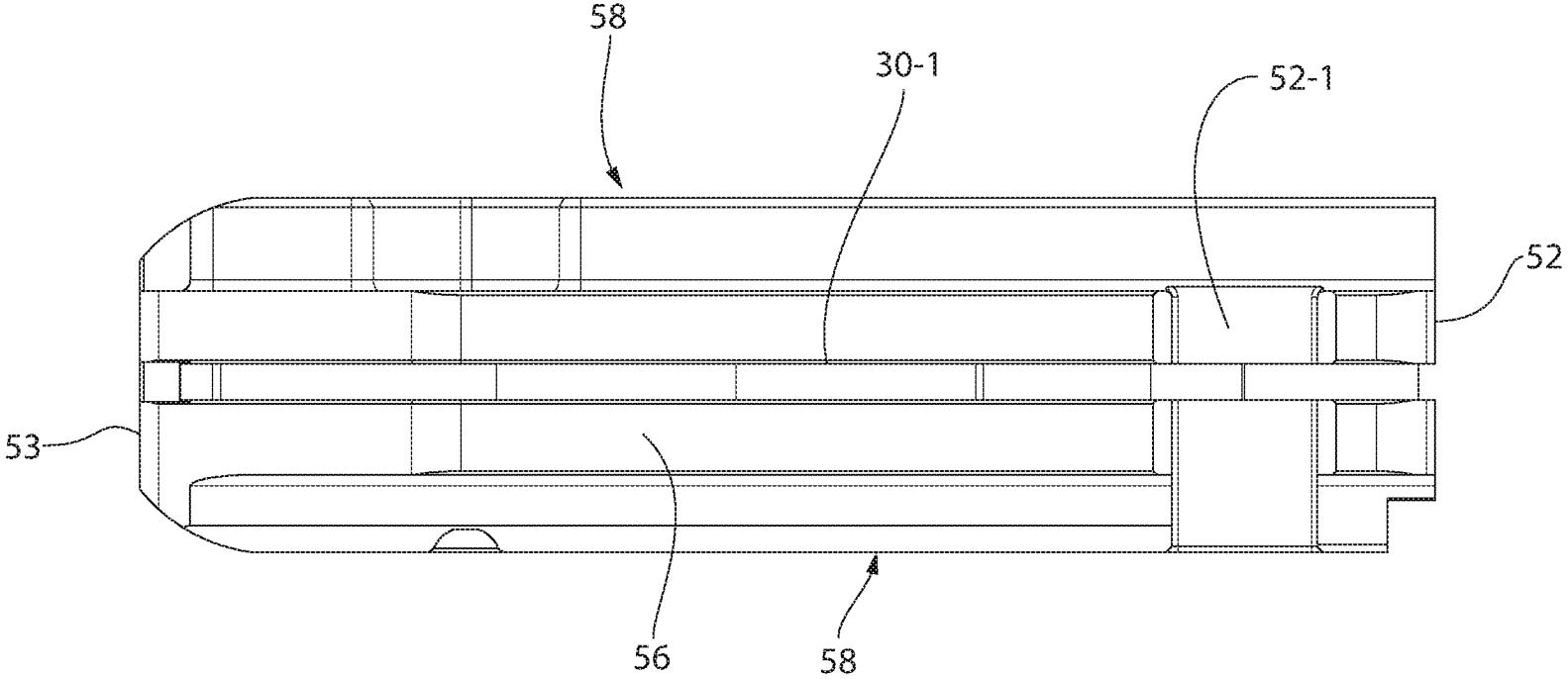
FIG. 18 is a top plan view thereof.
Figure 19:
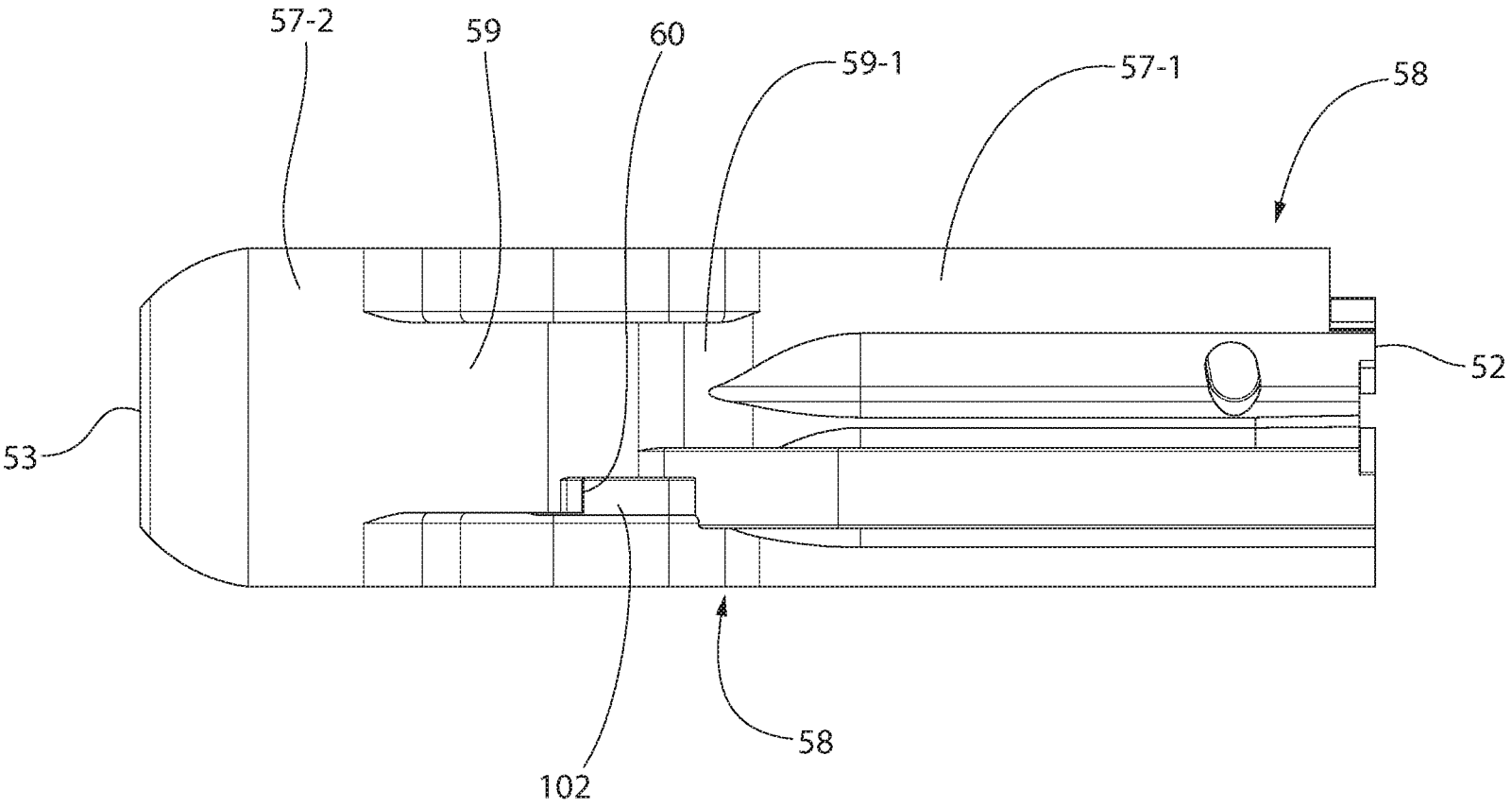
FIG. 19 is a bottom plan view thereof.
Figure 20:
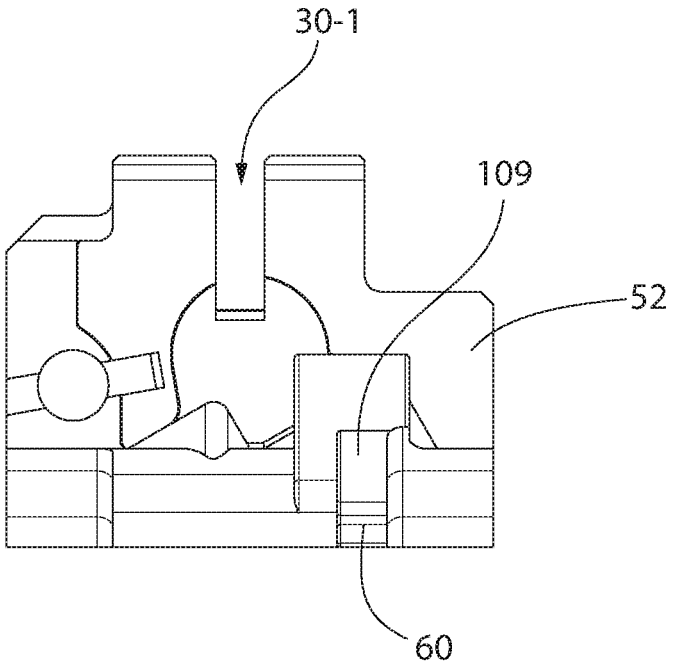
FIG. 20 is a front view thereof.
Figure 21:
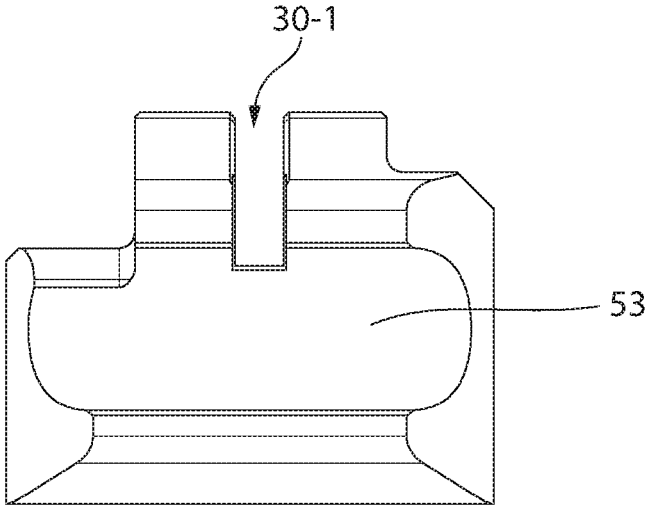
FIG. 21 is a bottom view thereof.
Figure 22:
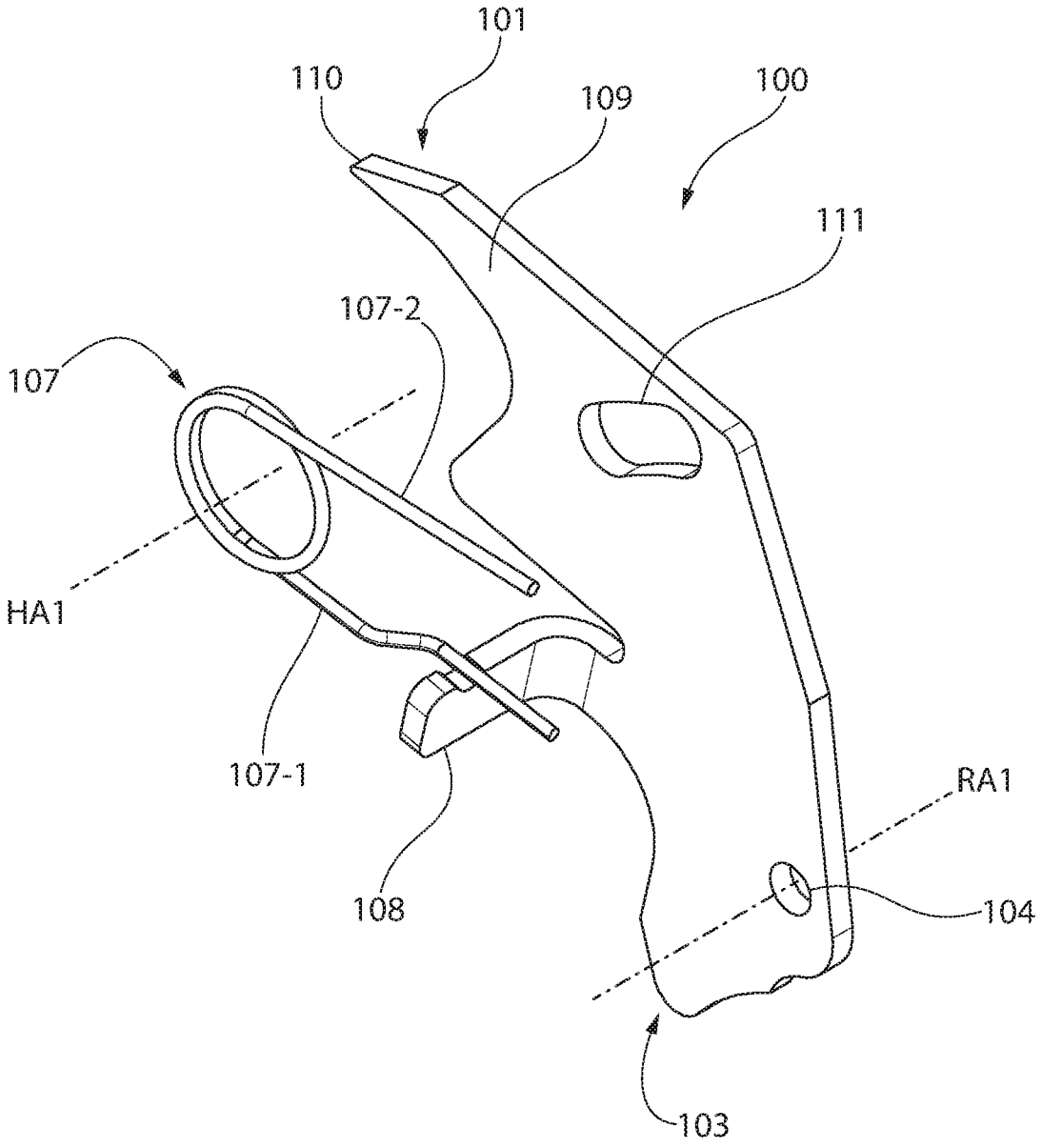
FIG. 22 is a right perspective view of the bolt release with related operating spring.
Figure 23:
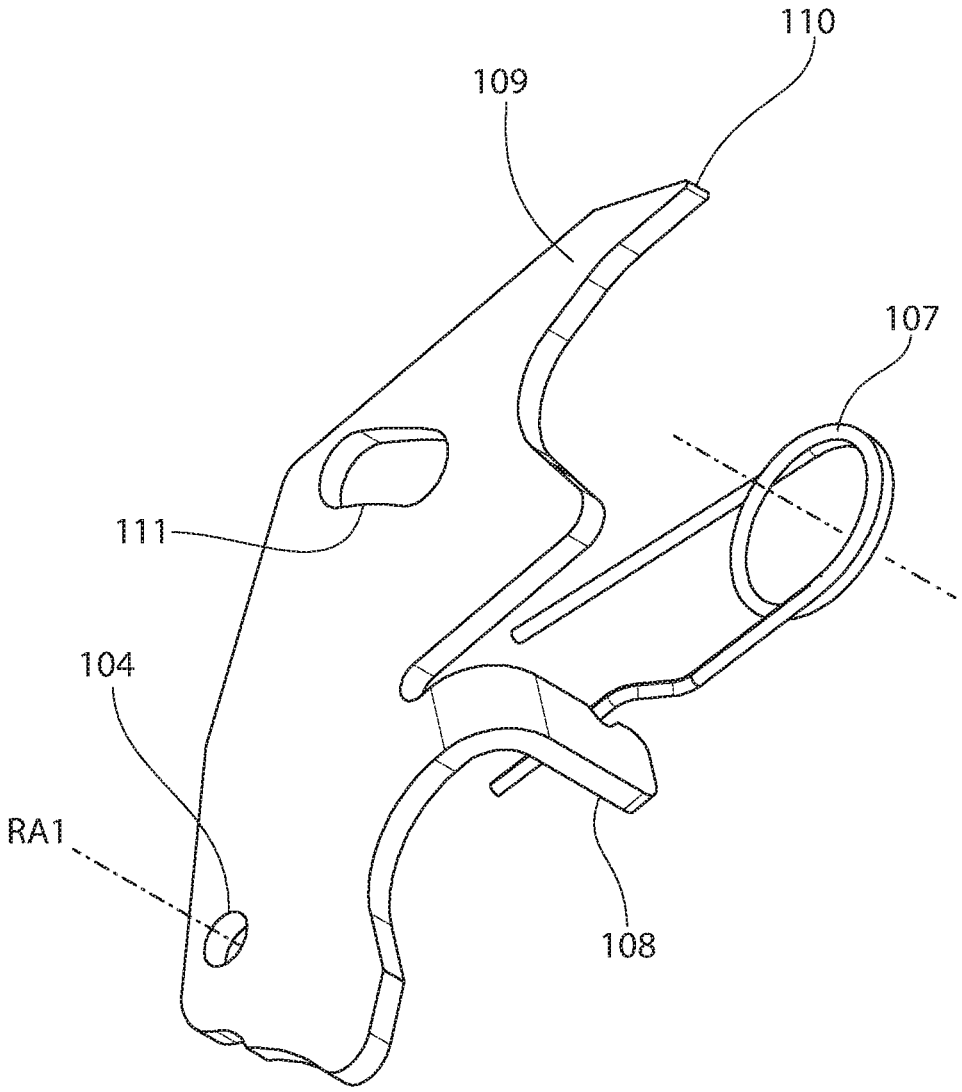
FIG. 23 is a left perspective view thereof.
Figure 24:
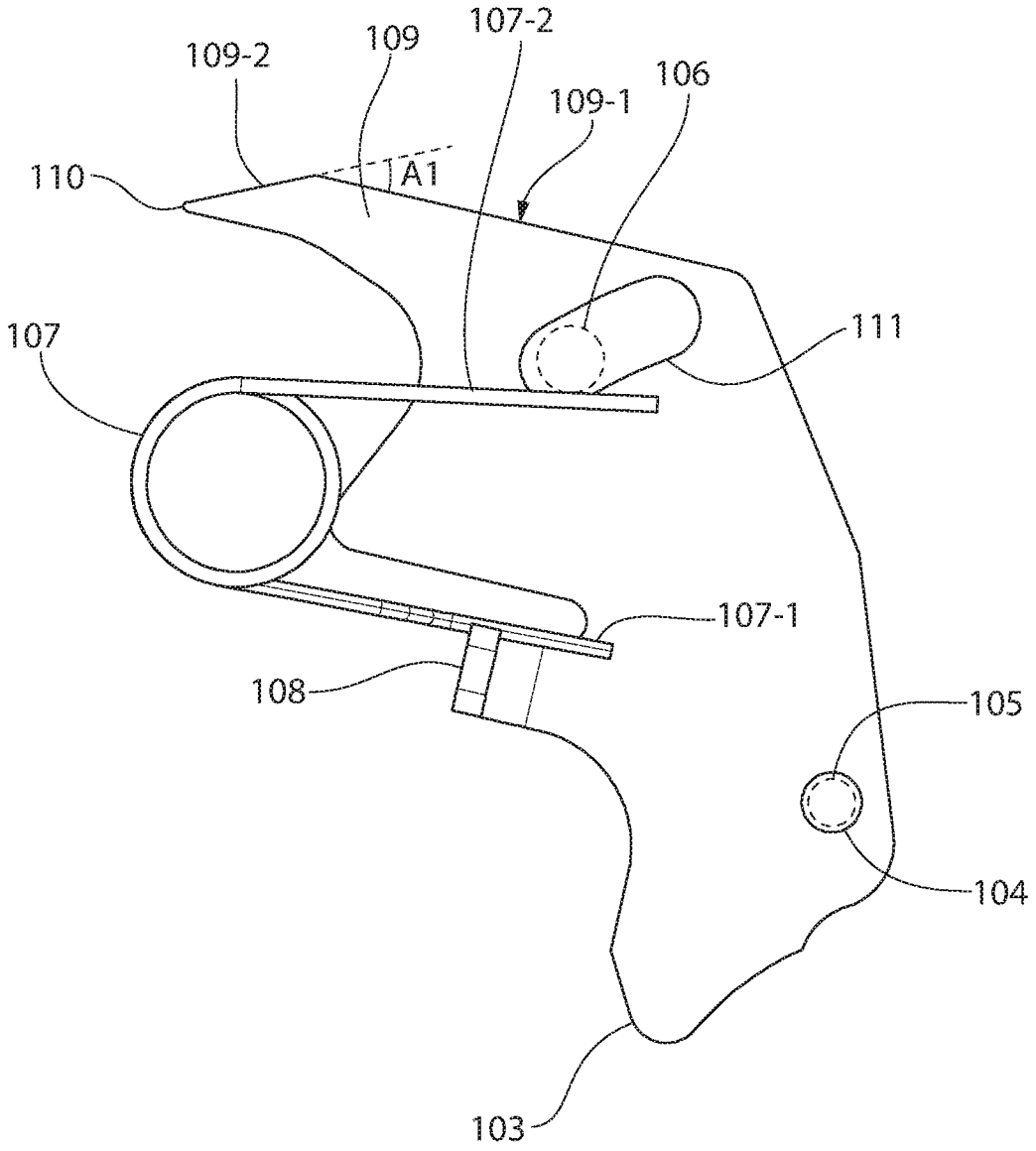
FIG. 24 is a right view thereof.
Figure 25:
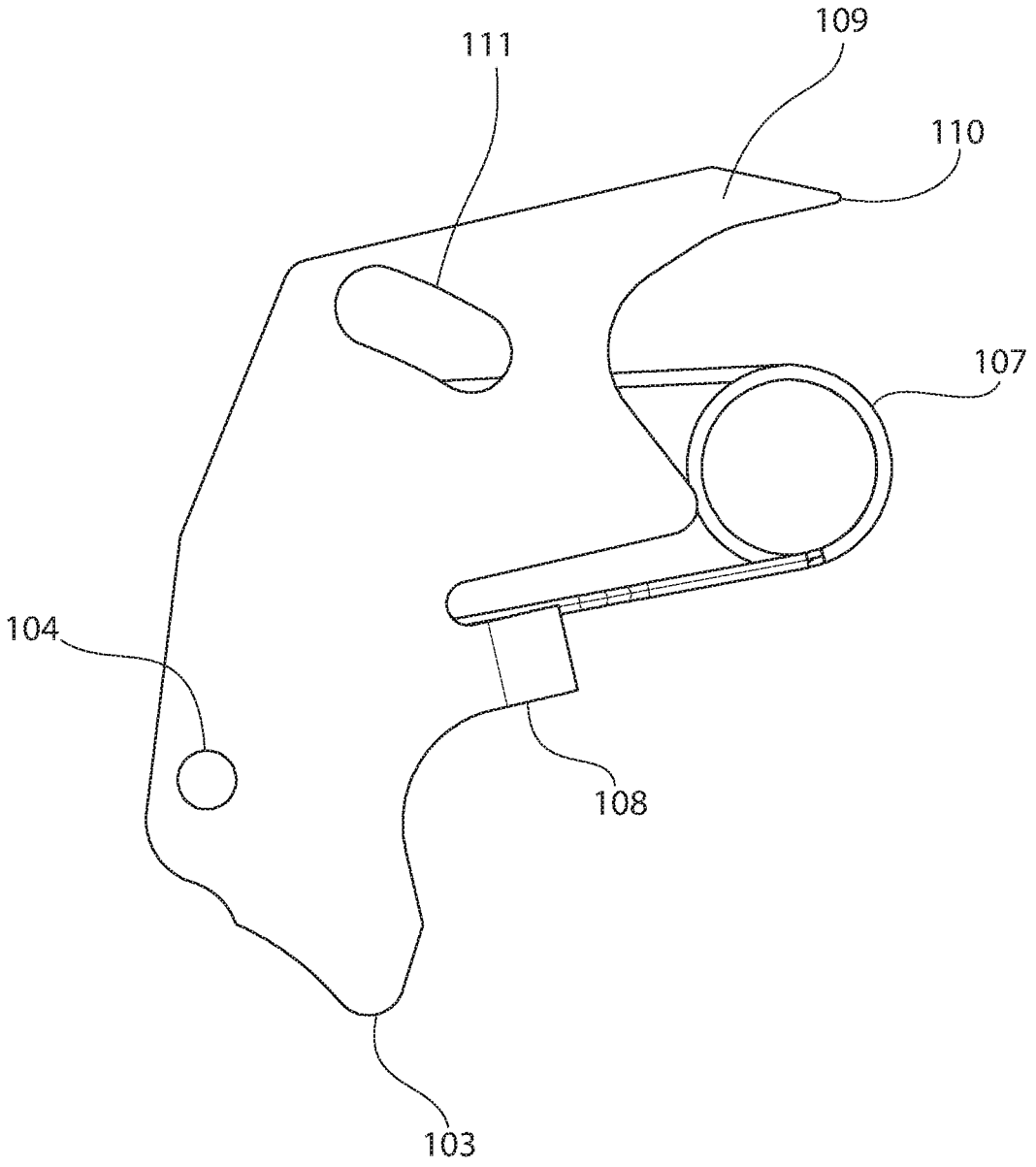
FIG. 25 is a left view thereof.
Figure 26:
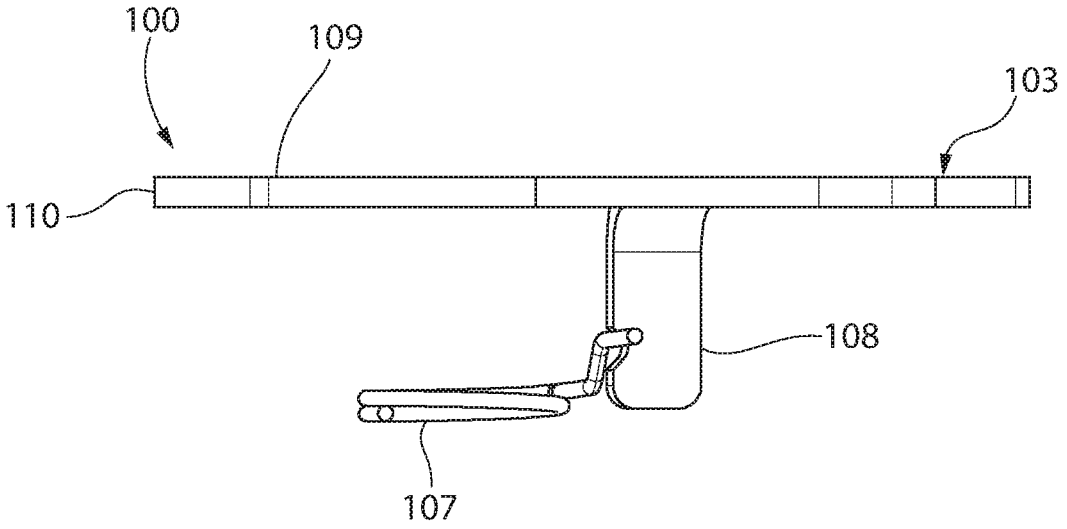
FIG. 26 is a bottom plan view thereof.
Figure 27:
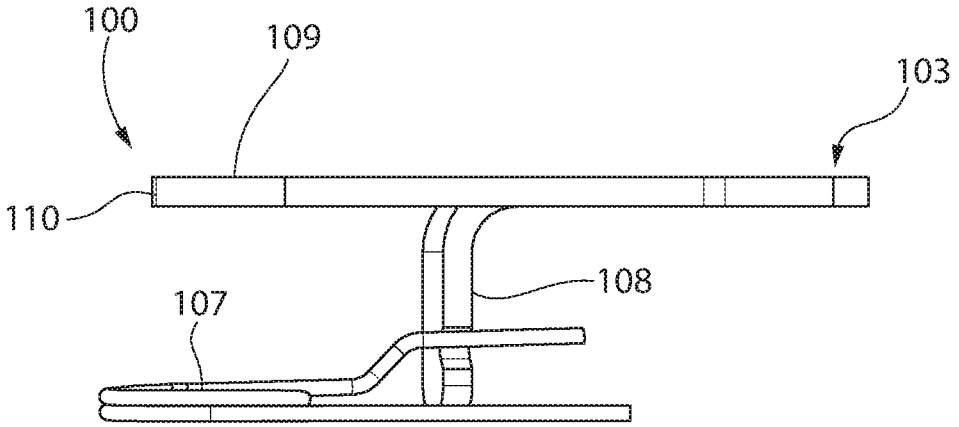
FIG. 27 is a top plan view thereof.

The foregoing angled geometry on the bolt 50 and bolt release 100 can be seen in detail in FIGS. 16 and 24. Referring to FIG. 16, the bolt hooked retention ledge 60 comprises an upward facing top surface 60-1 within the locking recess 102 which is obliquely angled to the longitudinal axis LA, and a forward facing angled surface 60-2 forming an oblique angle A2 therebetween. Referring to FIG. 24, the locking protrusion 109 of bolt release 100 comprises an upward facing top surface 109-1 and a downward sloping angled surface 109-2 forming an oblique angle A1 therebetween. The angled surface 109-2 on bolt release 100 contacts the angled surface 60-1 on the bolt 50 when the bolt returns forward to force the bolt release downward if the operating spring 107 does not act quickly enough to return the bolt release to the lower disengaged position when engagement is broken between the release and bolt.

Referring to FIGS. 14-21, locking recess 102 in one embodiment may be formed proximate to the bottom and rear portion of the bolt 50. In one arrangement, locking recess 102 may be formed in one of the lateral sides 58 of the bolt body such as on a downwardly extending ramp portion 59 of the bolt at a bottom rear end portion thereof. Ramp portion 59 may have a lateral width less than the width of the bolt body as shown. In the illustrated embodiment, the locking recess is shown in the left lateral side of the bolt 50; however, the recess can be on the right lateral side in other embodiments. The ramp portion 59 defines a forward facing inclined surface 59-1 on the bottom 57 of the bolt which is oriented obliquely to the longitudinal axis. The inclined surface 59-1 is configured to form a smooth and arcuately rounded gradual transition between the higher front bottom surface 57-1 of the bolt 50 below its forward portion and the lower rear bottom surface 57-2 of the bolt defined by the downwardly extending ramp portion 59 (see, e.g. FIGS. 15-17). The front and rear bottom surfaces 57-1 and 57-2 may be substantially flat in side profile and oriented parallel to the longitudinal axis LA.

Locking recess 102 is forwardly open including an open front end, closed top, closed bottom, and closed rear end in one embodiment. The locking recess 102 may also be laterally open as shown; however, in other constructions recess 102 may be laterally closed on each side. The rear end of locking recess 102 may be arcuately rounded. The bottom of locking recess 102 may be defined by hooked-shaped retention ledge 60 formed adjacent to the locking recess 102. The retention ledge is configured to engage the hook-shaped terminal end 110 of the bolt release locking protrusion 109 to prevent the locking protrusion from slipping out of locking recess 102 and maintain the open breech (see, e.g. FIG. 10). This advantageously creates a strong positive and secure engagement between the bolt release 100 and bolt 50 which is resistant to dislodging by inadvertent bumping or jarring of the firearm. When mutually engaged, the locking protrusion 109 is disposed on top of the retention ledge 60 and trapped in the locking recess 102.

Figure 5:
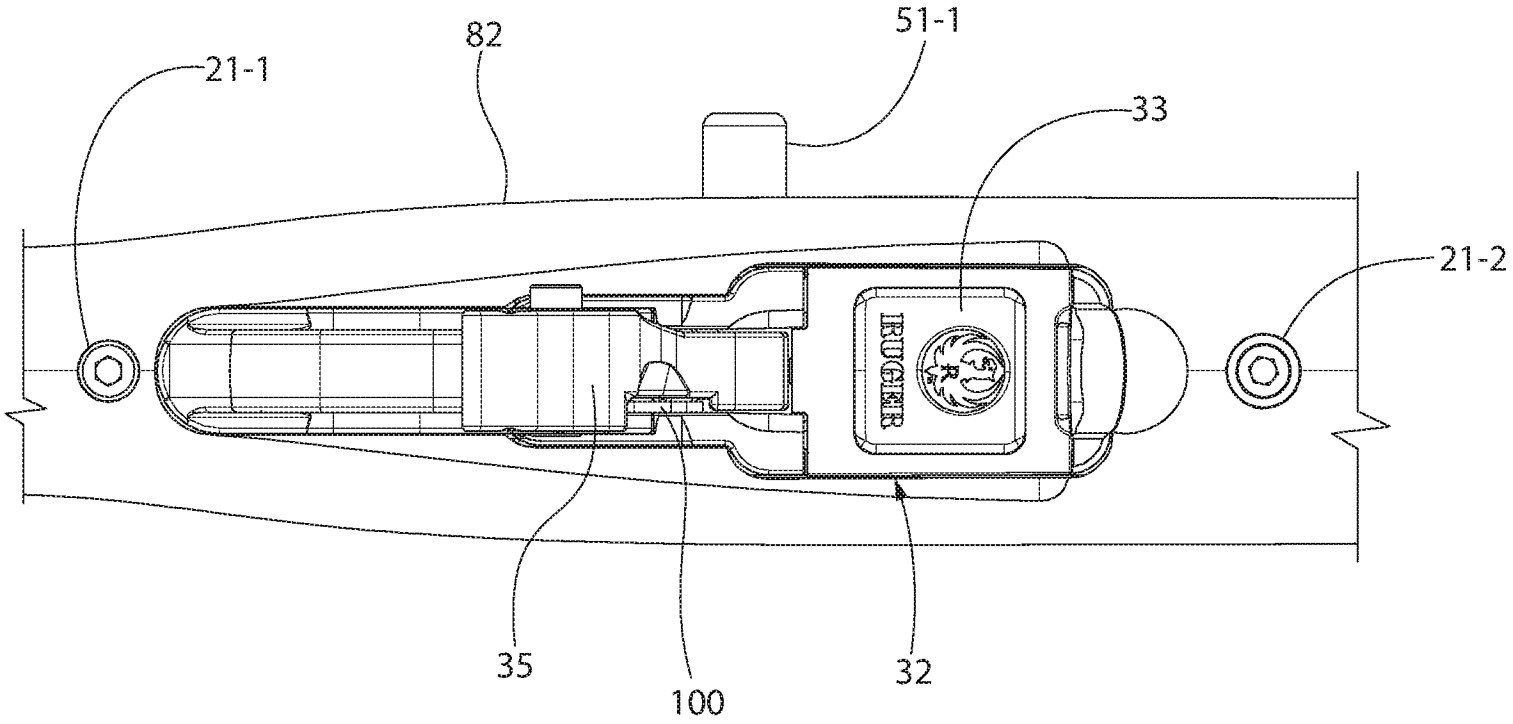
FIG. 5 is an enlarged view taken from FIG. 4 of the mid-stock area.
Figure 6:
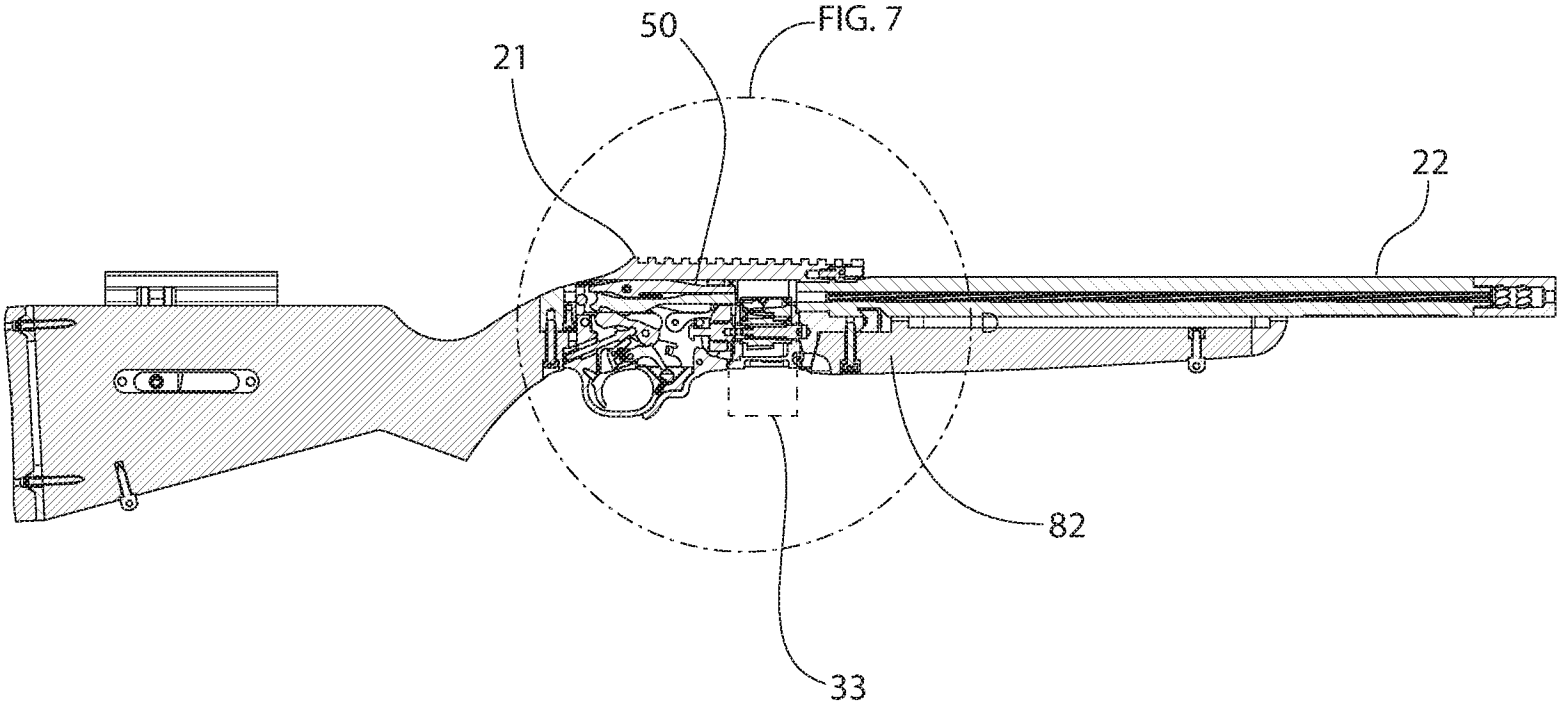
FIG. 6 is a right side cross-sectional view of the firearm of FIG. 1.
Figure 12:
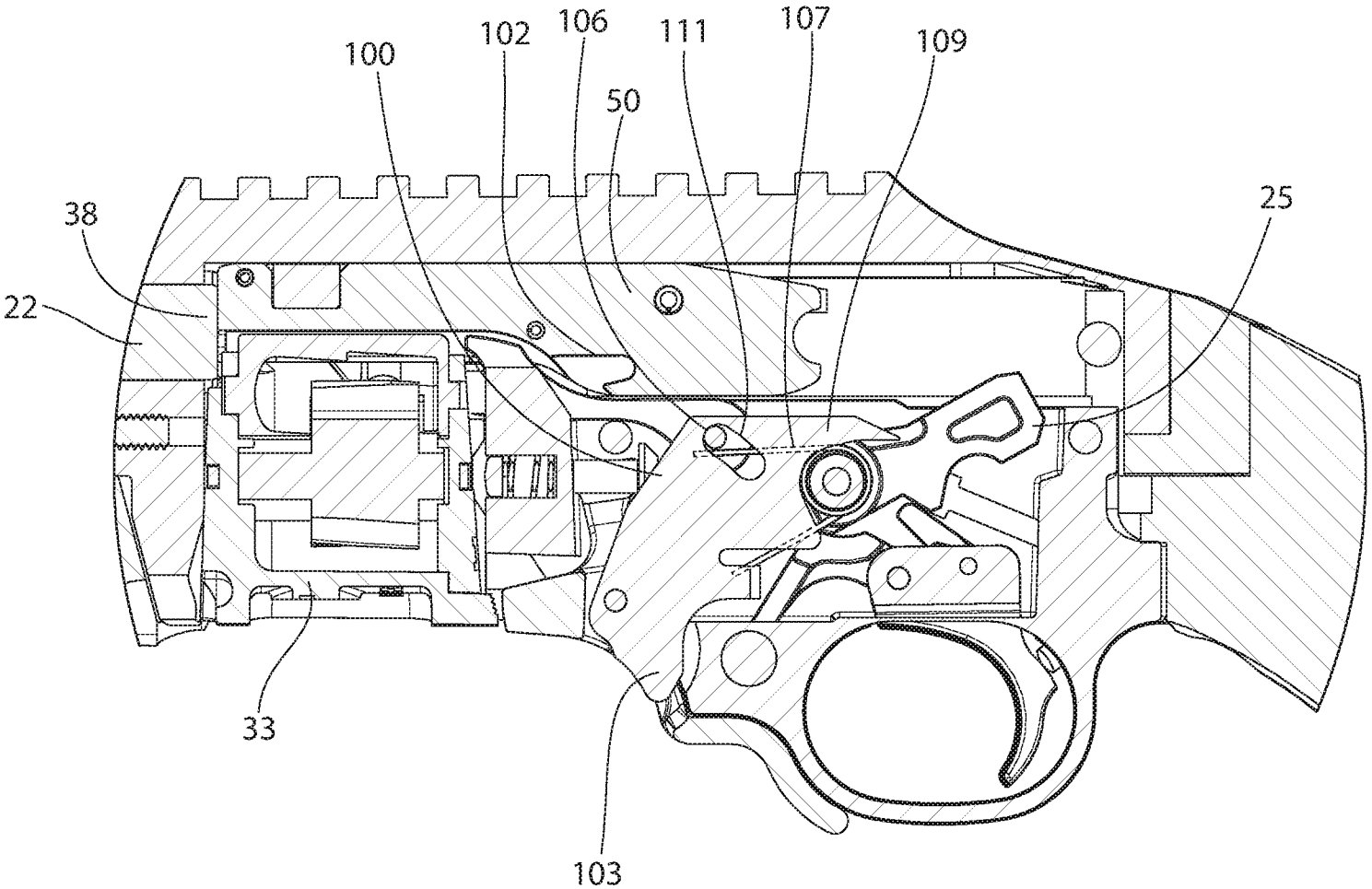
FIG. 12 is an enlarged view thereof showing the bolt release mechanism in a third operational position.

To manually actuate the bolt release 100, the lower operating portion 103 of the release is externally accessible for a user to depress and pivotably move the bolt release from the lower disengaged position (see, e.g. FIG. 12) to the activated upper engaged position (see, e.g. FIGS. 7 and 10). In one embodiment, the operating portion 103 of the bolt release protrudes forwardly from trigger housing 23-1 of the firearm proximate to a trigger guard 24-1 area as best shown in FIGS. 3, 5, and 12. Operating portion 103 may be generally lobe-shaped and is nested alongside the magazine release lever latch 35 (see, e.g. FIGS. 3, 5, and 10).

When the bolt release 100 is in the lower disengaged position from bolt 50 shown in FIG. 12, the substantially linear top surface of the bolt release (with exception of angled surface 109-2 of locking protrusion 109) is oriented parallel to longitudinal axis LA and the substantially flat front and rear bottom surfaces 57-1, 57-2 of the bolt (shown in FIG. 16). The bolt release operating portion 103 is forced forward and protrudes a maximum amount from trigger housing 23-1 under the downward biasing action of operating spring 107 acting on extension arm 108 since the operating portion is below the rotational axis RA1 of the bolt release 100 defined by pivot pin 105 (whereas the locking protrusion 109 is above axis RA1 and is biased downward by spring 107).

Conversely, when the bolt release 100 is in the upper engaged position with the bolt 50 shown in FIG. 10, the substantially linear top surface of the bolt release is oriented obliquely to longitudinal axis LA and the substantially flat front and rear bottom surfaces 57-1, 57-2 of the bolt. The bolt release operating portion 103 has been manually pushed rearward and is at least partially retracted into trigger housing 23-1 against the downward biasing action of operating spring 107.

A process or method for operating bolt release 100 of firearm 20 will now be briefly described with reference to FIGS. 10-12 which show various sequential views in operation of the bolt release. The operating sequence starts with the firearm in a ready-to-fire position with a closed breech as shown in FIG. 12. Bolt 50 is in battery with rear breech end of the barrel 22 under the forward biasing action of recoil spring 54. The bolt release 100 is in the normal downward and lower disengaged position from bolt 50 under the biasing action of operating spring 107. The guide pin 106 is at the front end of the travel limit guide slot 111.

To open the breech, the user pulls and manually retracts the bolt 50 rearward using the operating end 51-1 of the handle 51. This action compresses recoil spring 54 which stores energy for automatically returning the bolt forward later in the process. The bolt may be pulled fully rearward far enough to the point where the locking recess 102 on the lower side of the bolt is located rearward of the terminal end 110 of the bolt release locking protrusion 109. The user depresses and pushes the operating portion 103 of bolt release 100 rearward which rotates the bolt release from the lower disengaged position to the upper engage position. The locking protrusion 109 is now positioned in the forward path of the locking recess 109 to intercept the recess. While continuing to depress the bolt release, the user allows the recoil spring 54 to return the bolt 50 partially forward to engage and insert the bolt release locking protrusion 109 into the locking recess 102. In one embodiment, the terminal end 110 of the bolt release locking protrusion 109 may contact the closed rear end of the locking recess. The bolt release 100 and bolt 50 are now fully engaged and interlocked as shown in FIG. 10. When the user releases the bolt release and bolt, the bolt release restrains and arrests forward movement of bolt to maintain an open breech.

Figure 11:
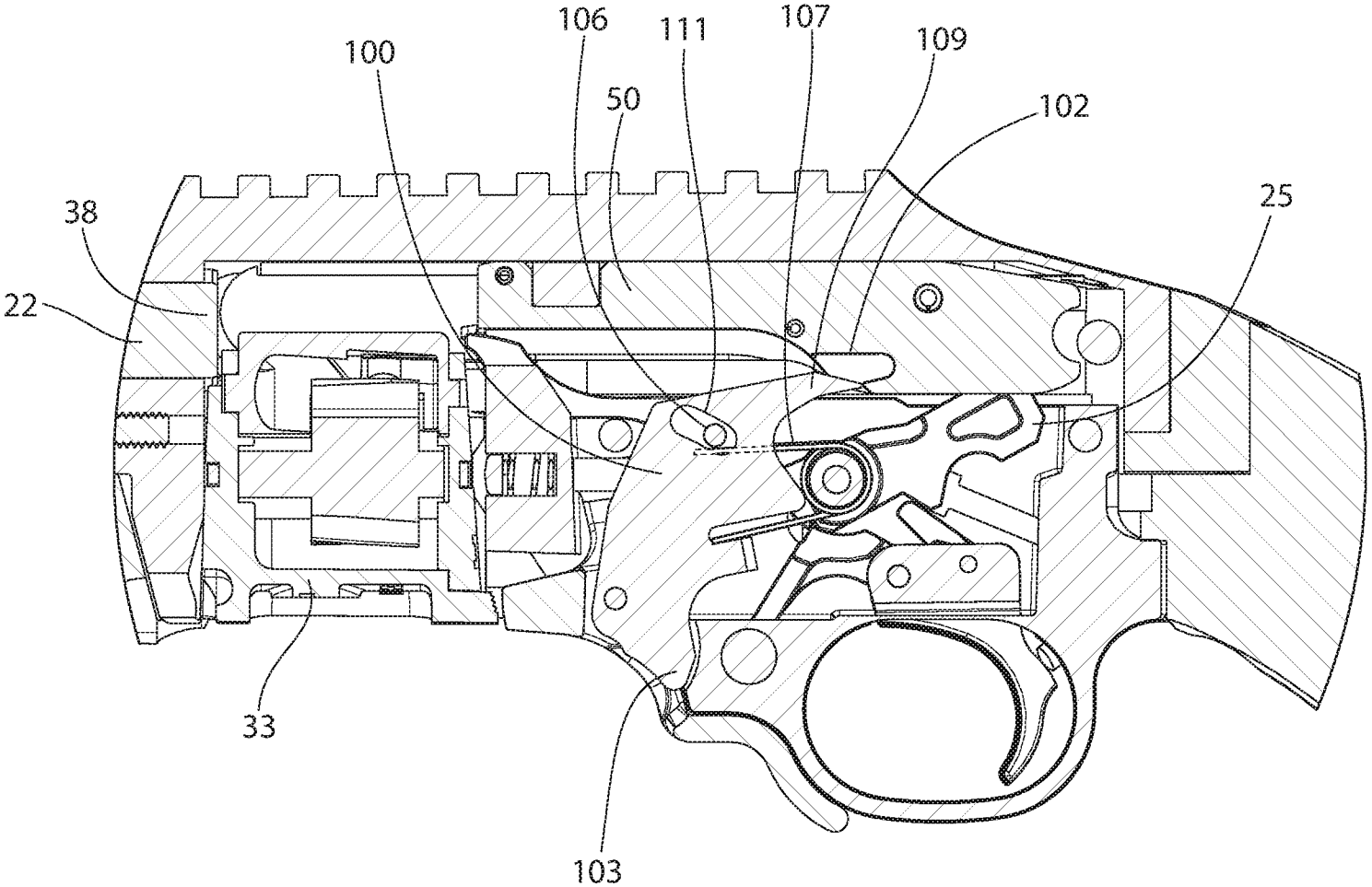
FIG. 11 is an enlarged view thereof showing the bolt release mechanism in a second operational position.

To reclose the breech, the user simply retracts the bolt 50 rearward a short distance far enough to disengage the locking protrusion 109 of bolt release 100 from the locking recess 102 (see, e.g. FIG. 11 showing terminal end 110 of the locking protrusion disengaged from the locking recess). Once disengaged from the bolt 50, the bolt release automatically springs back downward to the lower disengaged position once engagement is broken between the release and bolt. Completion of this action is both audibly and visually evident to the user by observing the operating portion 103 of the bolt release returning to its full outward position at the front of the trigger guard. The user may now simply release the bolt 50 which will be automatically returned fully forward to the closed breech position via the recoil spring 54 as shown in FIG. 12. It bears noting that the above steps of reclosing the breech are advantageously completed without the user having to touch the bolt release 100 again a second time.

While the foregoing description and drawings represent preferred or exemplary embodiments of the present invention, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes as applicable described herein may be made without departing from the spirit of the invention. One skilled in the art will further appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims and equivalents thereof, and not limited to the foregoing description or embodiments. Rather, the appended claims should be construed broadly, to include other variants and embodiments of the invention, which may be made by those skilled in the art without departing from the scope and range of equivalents of the invention.

What is claimed is:

1. A firearm with bolt release mechanism comprising:

a longitudinal axis;

a receiver defining a longitudinally-extending cavity;

a barrel supported by the receiver;

a bolt slideably mounted in the receiver for reciprocating axial movement between a forward closed breech position in battery with the barrel and a rearward open breech position;

a recoil spring biasing the bolt forward towards the closed breech position;

a manually actuated bolt release pivotably movable between an engaged position and a disengaged position;

the bolt release including a rear locking portion configured to selectively (1) engage a locking recess formed on the bolt for holding the bolt in the open breech position when the bolt release is in the engaged position, and (2) to disengage the locking recess for releasing the bolt from the open breech position when the bolt release is in the disengaged position;

wherein the bolt release further includes an externally accessible front operating portion configured for a user to pivotably move the bolt release from the disengaged position to the engaged position;

wherein the front operating portion of the bolt release protrudes forwardly from a trigger housing of the firearm proximate to a trigger guard and the rear locking portion extends longitudinally rearwards from the front operation portion.

2. The firearm according to claim 1, wherein the locking portion of the bolt release comprises a rearwardly extending finger-shaped locking protrusion which is insertable into the locking recess of the bolt when the bolt release is in the engaged position.

3. The firearm according to claim 2, wherein the bolt includes a hooked-shaped retention ledge formed adjacent to the locking recess, the retention ledge arranged to engage the locking protrusion of the bolt release when in it's the bolt release is in the engaged position.

4. The firearm according to claim 2, wherein the locking recess is forwardly open to receive the locking protrusion of the bolt release.

5. The firearm according to claim 2, wherein the bolt release has an elongated flat plate-like body including a pivot hole which receives a pivot pin defining an axis of rotation of the bolt release.

6. The firearm according to claim 1, wherein the locking recess is formed as an outwardly facing cavity in a lateral side of the bolt proximate to a bottom of the bolt.

7. The firearm according to claim 6, wherein the locking recess is laterally open.

8. The firearm according to claim 6, wherein the locking recess is formed in a downwardly extending ramp portion of the bolt at a bottom rear end portion thereof.

9. The firearm according to claim 8, wherein the ramp portion defines a forward facing inclined surface oriented obliquely to the longitudinal axis.

10. The firearm according to claim 8, wherein the locking recess is laterally open.

11. The firearm according to claim 1, further comprising an operating spring which biases the bolt release into the disengaged position.

12. The firearm according to claim 11, wherein the engaged position of the bolt release is an upper position and the disengaged position is a lower position.

13. The firearm according to claim 11, wherein manually pulling the bolt rearward when the bolt release is in the engaged position automatically disengages the locking portion from the locking recess, and returns the bolt to the forward closed breech position via the recoil spring.

14. The firearm according to claim 13, wherein the bolt release further comprises an arcuately shaped guide slot which receives a guide pin to limit pivotable movement of the bolt release.

15. The firearm according to claim 11, wherein the bolt release further comprises a lateral extension arm engaged by an operating spring which biases the bolt release into the disengaged position.

16. A firearm with bolt release mechanism comprising:

a longitudinal axis;

a receiver defining a longitudinally-extending cavity;

a barrel supported by the receiver;

a bolt slideably mounted in the receiver for reciprocating axial movement between a forward closed breech position in battery with the barrel and a rearward open breech position;

a recoil spring biasing the bolt towards the closed breech position;

a trigger housing detachable mounted to the receiver and comprising a trigger-actuated firing mechanism;

a manually actuated bolt release pivotably mounted in the trigger housing;

the bolt release having a flat plate-like body including a front operating portion and a locking portion extending rearwardly therefrom, the locking portion configured to (1) selectively engage an outwardly open locking recess formed in a rear lateral side of the bolt for holding the bolt in the open breech position when the bolt release is in an upper engaged position, and (2) to disengage the locking recess for releasing the bolt from the open breech position when the bolt release is in a disengaged position.

17. The firearm according to claim 16, wherein the locking portion of the bolt release comprises a rearwardly extending hook-shaped locking protrusion which is insertable into the locking recess of the bolt when the bolt release is in the engaged position.

18. The firearm according to claim 17, wherein the bolt includes a hooked-shaped retention ledge formed adjacent to the locking recess, the retention ledge arranged to engage the locking protrusion of the bolt release when the bolt release is in the engaged position.

19. The firearm according to claim 18, wherein the locking recess is forwardly open to receive the locking protrusion of the bolt release.

20. The firearm according to claim 19, wherein the locking recess is formed proximate to a bottom of the bolt.

21. The firearm according to claim 16, wherein the bolt release includes an externally accessible operating portion for a user to pivotably move the bolt release from the disengaged position to the engaged position.

22. The firearm according to claim 21, wherein the operating portion of the bolt release protrudes forwardly from the trigger housing of the firearm proximate to a trigger guard.

23. A firearm with bolt release mechanism comprising:

a longitudinal axis;

a receiver defining a longitudinally-extending cavity;

a barrel supported by the receiver;

a bolt slideably mounted in the receiver for reciprocating axial movement between a forward closed breech position in battery with the barrel and a rearward open breech position;

a recoil spring biasing the bolt towards the closed breech position;

a trigger housing detachable mounted to the receiver and comprising a trigger-actuated firing mechanism comprising a trigger;

a manually actuated bolt release pivotably mounted in the trigger housing;

the bolt release having a body including a downwardly extending front operating portion arranged forward of the trigger, and a rear locking portion defining a longitudinally elongated locking protrusion extending rearwardly from the operating portion;

wherein when the bolt is in the rearward open breech position: (i) moving the operating portion of the bolt release rearwardly towards the trigger raises the locking protrusion upwards to an engaged position for engaging a locking recess in a rear end of the bolt which prevents the bolt from returning to the closed breech position; and (2) moving the operating portion of the bolt release forwardly away from the trigger pivotably lowers the locking protrusion downwards to a disengaged position for disengaging the locking release which allows the bolt to return to the closed breech position.

24. The firearm according to claim 23, wherein the operating portion of the bolt release protrudes forwardly from the trigger housing forward of the trigger.

25. The firearm according to claim 24, wherein the locking recess is formed in a rear lateral side of the bolt and is outwardly open.

26. The firearm according to claim 23, wherein the bolt includes a longitudinally elongated retention ledge formed below defining a closed bottom of the locking recess such that the locking protrusion of the bolt release in only longitudinally insertable into the locking recess.

27. The firearm according to claim 26, wherein the locking protrusion of the bolt release comprises an upward facing angled top surface which is engageable with a corresponding downward facing angled surface defined by the retention ledge on the bolt when the bolt moves from the rearward open breech position to the forward closed breech position.

28. The firearm according to claim 26, wherein the locking protrusion of the bolt release is terminated with a pointed end.

29. The firearm according to claim 23, wherein the locking recess of the bolt is formed in a ramp portion extending downwardly from a bottom of the bolt at a rear end thereof, the ramp portion defining a forward facing inclined surface oriented obliquely to the longitudinal axis of the firearm.

30. The firearm according to claim 23, further comprising an operating spring which engages a lateral extension arm projecting perpendicularly outwards from the main body of the bolt release, the spring biasing the locking protrusion of the bolt release downwardly towards the disengaged position.

* * * * *